US012504251B2

(12) United States Patent
Anselmo

(10) Patent No.: US 12,504,251 B2
(45) Date of Patent: Dec. 23, 2025

(54) ARCHERY BOW AND RELATED APPARATUSES

(71) Applicant: HOYT ARCHERY, INC., Salt Lake City, UT (US)

(72) Inventor: Dan'l J. Anselmo, South Jordan, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 168 days.

(21) Appl. No.: 18/360,319

(22) Filed: Jul. 27, 2023

(65) Prior Publication Data

US 2024/0044606 A1 Feb. 8, 2024

Related U.S. Application Data

(60) Provisional application No. 63/395,605, filed on Aug. 5, 2022.

(51) Int. Cl.
*F41B 5/14* (2006.01)
*F41B 5/00* (2006.01)
*F41B 5/10* (2006.01)

(52) U.S. Cl.
CPC ..... *F41B 5/0068* (2013.01); *F41B 5/105* (2013.01); *F41B 5/14* (2013.01)

(58) Field of Classification Search
CPC ..... F41B 5/0068; F41B 5/105; F41B 5/14; F41B 5/1426; F41B 5/1442; F41B 5/148; F41B 5/1403
USPC ..... 124/86, 89, 1
See application file for complete search history.

(56) References Cited

U.S. PATENT DOCUMENTS

| | | | | |
|---|---|---|---|---|
| 5,427,085 | A * | 6/1995 | Martin | F41B 5/1496 124/1 |
| 5,832,912 | A * | 11/1998 | Olivarez | F41B 5/1457 206/315.11 |
| 5,881,704 | A * | 3/1999 | Andrews | F41B 5/10 124/23.1 |
| 6,712,059 | B2 * | 3/2004 | Donovan | F41B 5/1426 188/378 |
| 9,689,640 | B2 * | 6/2017 | Houle | F16F 1/36 |
| 11,448,479 | B1 * | 9/2022 | Liu | F41B 5/105 |
| 2004/0107952 | A1 * | 6/2004 | Kronfeld | F41B 5/1426 124/89 |
| 2014/0041645 | A1 * | 2/2014 | Wasilewski | F41B 5/1426 124/89 |

* cited by examiner

*Primary Examiner* — John E Simms, Jr.
(74) *Attorney, Agent, or Firm* — DORSEY & WHITNEY LLP

(57) ABSTRACT

An archery bow can include a limb assembly having a limb and a cover member. The limb includes a distal end and a proximal end. The cover member can be coupled to the limb between the distal and proximal ends. The limb can have a region disposed laterally adjacent to a cam of the archery bow. The cover member can be at least partially disposed on the region. The limb can define a first length and the cover member can define a second length. The first length and the second length can define a ratio. In some examples, the limb and/or the cover member can include a plurality of protrusions extending therefrom.

20 Claims, 16 Drawing Sheets

ARCHERY BOW AND RELATED APPARATUSES

RELATED APPLICATION

This application claims the benefit of U.S. Provisional App. No. 63/395,605, filed on 5 Aug. 2022, which is hereby incorporated by reference herein in its entirety.

TECHNICAL FIELD

The present disclosure generally relates to archery equipment and specifically relates to incorporating a cover member onto one or more limbs of an archery bow.

BACKGROUND

Bowhunters and other archers use finely tuned archery equipment to launch arrows and other projectiles down range. For example, bows include one or more limbs which deflect or bend as the archer draws the archery bow. While bent or flexed, the limbs of the archery bow provide potential energy transferred to the projectile through the bowstring when the projectile is launched. The design and features of the limbs can affect the archer's shooting experience and ultimately impact the performance of the archery bow. Accordingly, there is a constant need for improvements to various types of archery equipment, such as, the functionality and performance of archery bow limbs.

SUMMARY

One aspect of the present disclosure relates to an archery bow including a riser, a limb, a cam, and a cover member. The limb is coupled to the riser. The limb defines a first length. The cam is rotatably coupled to the limb. The limb has a region disposed laterally adjacent to the cam. The cover member is coupled to the limb. At least a portion of the cover member is disposed on at least a portion of the region. The cover member defines a second length. A ratio of the first length to the second length is equal to or between 5:1 and 1.5:1.

In some examples, the limb can define a tensile surface and a compression surface disposed opposite the tensile surface. At least a portion of the tensile surface or the compression surface can form the region. In some examples, the limb defines a first lateral surface and a second lateral surface. The cover member can be at least partially disposed on at least one of the first lateral surface or the second lateral surface. In some examples, the limb comprises a distal end and a proximal end. A first distance between the distal end of the limb and the cover member is less than a second distance between the proximal end of the limb and the cover member. In some examples, the archery bow can further include an axle rotatably coupling the cam to the limb. The region can be defined between the axle and a periphery of the cam.

In some examples, the cover member can have a first density and the limb can have a second density greater than the first density. In some examples, the limb can be a first limb and the cover member can be a first cover member. The archery bow can also include a second limb and a second cover member disposed on the second limb. In some examples, a majority of the cover member can be disposed on the region Another aspect of the disclosure relates to a cover member for an archery bow limb. The cover member includes a body defining a limb-facing surface and an external-facing surface. The limb facing-surface is configured to affix to at least one of a tensile surface of the archery bow limb or a compression surface of the archery bow limb. The cover member includes a pattern formed within the external-facing surface. The pattern extends along the external-facing surface in a first direction and a second direction.

In some examples, the first direction can be transverse to a longitudinal axis of the body. The second direction can be parallel to the longitudinal axis of the body. In some examples, the cover member can include a sidewall coupled to the body and extending substantially perpendicular to the limb-facing surface of the body. The sidewall can define a limb-facing surface configured to be coupled to a lateral surface of the archery bow limb. In some examples, the pattern can include a plurality of protrusions disposed on the external-facing surface. In some examples, the plurality of protrusions can be arranged in a repeating pattern. In some examples, the plurality of protrusions can be arranged in a random pattern. In some examples, a width of the body can vary over the length of the body. In some examples, the cover member can be configured to be affixed further from a proximal end of the archery bow limb than a distal end of the archery bow limb.

Yet another aspect of the present disclosure relates to a limb assembly for an archery bow. The limb assembly includes a limb and a cover member. The limb includes a first surface defining a first surface area. The cover member is disposed on the first surface area. The cover member forms a projected surface offset a distance from the first surface area. The distance is less than or equal to a minimum thickness of the limb. The projected surface defining a second surface area. A ratio of the first surface area to the second surface area being equal to or greater than 1.01:1.

In some examples, the first surface is parallel to the projected surface. In some examples, the first surface is disposed nearer a distal end of the limb than a proximal end of the limb.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
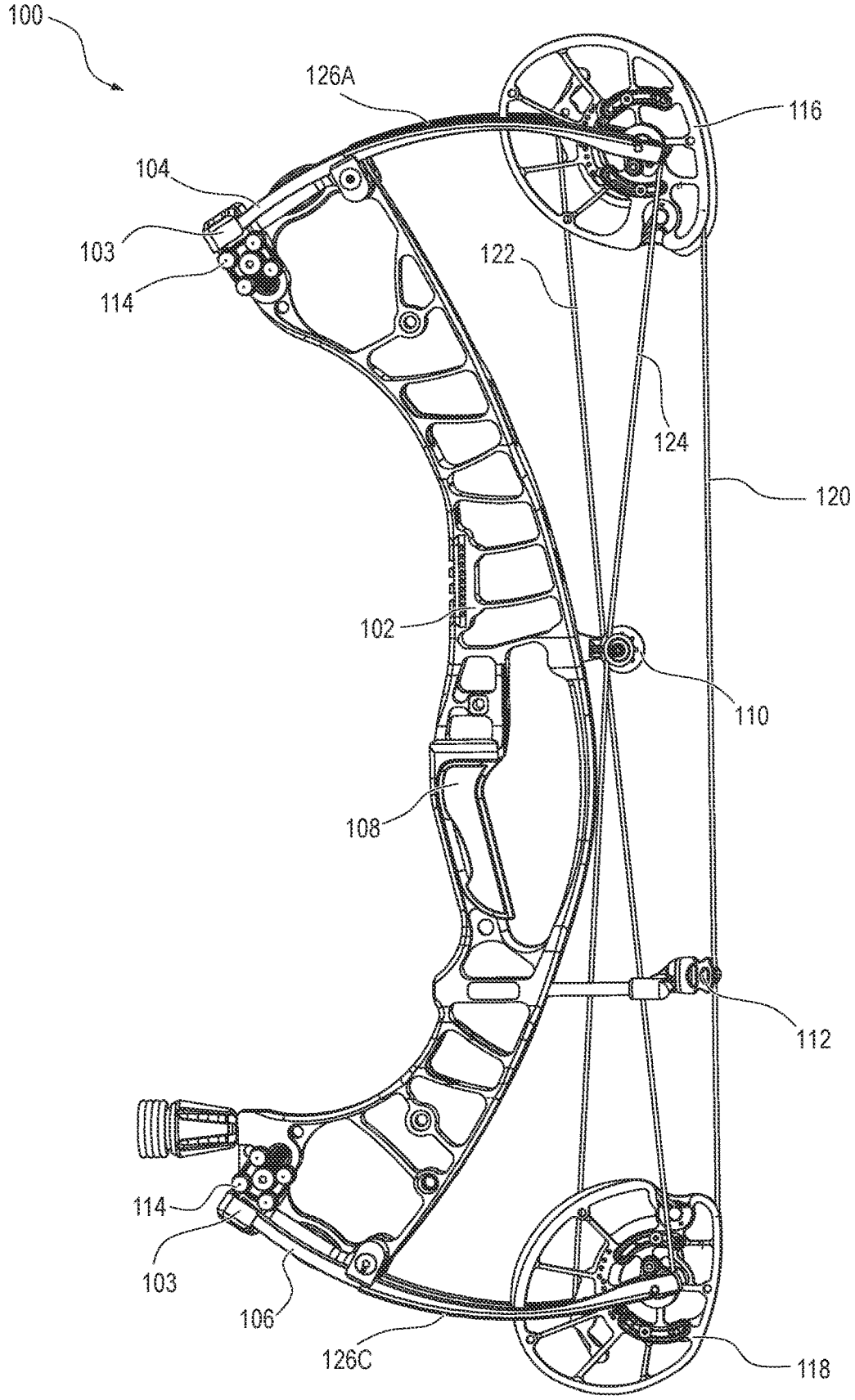
FIG. 1A is a side view of an archery bow.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

One aspect of the present disclosure generally relates to incorporating a cover member onto one or more surfaces of a limb of an archery bow. In some examples, the archery bow can include multiple limbs and each of the multiple limbs can have one or more respective cover members affixed thereto. Each of the limbs can have a distal end and a proximal end. The cover member can be disposed closer to the distal end in some examples and can be disposed closer to the proximal end in other examples. In some examples, the cover member can be disposed on the limb equidistant from the proximal end and the distal end. The cover member can extend or span between the distal and proximal ends of the limb in some examples. In some examples, the cover member can be at least partially disposed in a region of the limb that is laterally adjacent to a cam.

In some examples, the limb can define at least two respective surfaces which abut one another to form a lateral edge of the limb. For example, the limb can include a tension surface, a compression surface, a first lateral surface, and a second lateral surface. The first and second lateral surfaces can extend between the tension surface and the compression surface. One or more respective lateral edges can be formed where the tension surface abuts the first and second lateral surfaces of the limb. The lateral edge can extend along at least a portion of the length of the limb, such as, between the proximal and distal ends of the limb. In some examples, the limb can form respective lateral edges between each of the lateral surfaces and the tensile and compression surfaces. In some examples, one or more cover members can be coupled to the limb and can be disposed along at least a portion of one or more of the lateral edges.

In some examples, the limb can define a first length (e.g., a length of the limb extending between the distal end and the proximal end) and the cover member can define a second length. The first length (i.e., the length of the limb) and the second length (i.e., the length of the cover member) can define or correlate to a ratio, such as, equal to or less than 5:1. Meaning the length of the limb can be five times the length of the cover member or less than five times the length of the cover member (e.g., three times the length of the cover member; two and one-half times the length of the cover member; two times the length of the cover member, etc.).

In some examples, the cover member can include a plurality of protrusions extending from a surface of the cover member. For example, the cover member can define a limb-facing surface and an external-facing surface. The plurality of protrusions can be disposed on the external-facing surface. In some examples, the plurality of protrusions can be arranged in a repeating pattern. In some embodiments, the plurality of protrusions can be arranged randomly on the external-facing surface.

The cover member can be beneficial, for example, by improving the performance, durability, and/or other characteristics of the archery bow. In some examples, the cover member can mitigate or limit damage to an archery bow limb from an impact to the limb, such as, when the bow is mishandled or unintentionally dropped by an archer. In some examples, the cover member can alternatively, or additionally, dampen vibrations resultant from launching a projectile (e.g., an arrow) from the archery bow.

In some examples, the cover member can additionally, or alternatively, reduce or impede noise generated by movement of the limb when a projectile is launched from the archery bow. For example, a region of the limb nearest the cam (e.g., a distal end of the limb) can rapidly move or translate when a projectile is launched from the archery bow. A cover member can include a pattern or surface texture positioned at or near the distal portion of the limb to better reduce noise and other energy resultant of launching a projectile by attenuating, absorption, scattering, or otherwise impeding propagation of one or more frequencies of acoustic waves to minimize sound reflection (i.e., maximize acoustic impedance). For example, the cover member and/or one or more surfaces of the limb can include or define a pattern which acts as an irregular surface to diffuse acoustic waves by causing the acoustic waves to travel along a multitude of smaller paths, thereby dividing the energy associated with the acoustic waves in many different directions to more rapidly deplete or attenuate the energy.

In some examples, a plurality of protrusions can be machined, molded, formed, affixed, or otherwise present on one or more surfaces of the archery bow limb itself. For example, an archery bow limb can include a tensile surface, a compression surface, a first lateral surface, and a second lateral surface. The plurality of protrusions can be formed on one or more of the tensile surface, the compression surface, the first lateral surface, or the second lateral surface. In some examples, the plurality of protrusions can be applied, sprayed, adhered, or deposited onto the limb. In some examples, the plurality of protrusions can be machined, molded, or integrally formed with the limb. In some examples, the plurality of protrusions can be machined, molded, or otherwise formed on one or more surfaces of a cover member that is configured to be affixed to the limb.

The present description provides examples, and is not limiting of the scope, applicability, or configuration set forth in the claims. Thus, it will be understood that changes may be made in the function and arrangement of the cover members, protrusions, and/or other elements of the archery bow discussed without departing from the spirit and scope of the disclosure, and various embodiments may omit, substitute, or add other procedures or components as appropriate. For instance, features described with respect to certain embodiments may be combined in other embodiments.

Referring now to the figures in detail, FIG. 1A shows a compound archery bow 100. The bow 100 is at a rest position (e.g., a brace state or brace position). The bow 100 can comprise a riser 102 from which one or more upper limbs 104 and one or more lower limbs 106 extend. For example, the upper limbs 104 can be affixed to the riser 102 by one or more limb pockets 103. The bow 100 can include a grip 108, a roller guard or cable guard 110, a string-stop damper 112, dampers 114, and other components.

The upper limbs 104 may be connected to an upper cam assembly 116, and the lower limbs 106 may be connected to a lower cam assembly 118. A bowstring 120 (i.e., draw string) may extend across the length of the bow 100 between the upper cam assembly 116 and the lower cam assembly 118 when the bow 100 is positioned vertically upright in a normal shooting orientation. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the bow 100. The first and second cables 122, 124 may retain tension in the limbs 104, 106 and cam assemblies 116, 118 and may be controlled to adjust tension in the bowstring 120, draw length of the bowstring 120, and other tuning features of the bow 100.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, recurve bows, crossbows, their accessories, and other equipment related to archery. Similarly, archery equipment applying the teachings of the present disclosure does not need to implement all of the features of the present disclosure. For example, in some embodiments, the bow may not comprise a cable guard 110 or a string-stop damper 112, so features associated with those accessories may be omitted from the bow 100.

When shooting an arrow, the tail end of the arrow may be nocked with the bowstring 120 at a nocking point (not shown) while the bow 100 is in the brace position shown in FIG. 1A. The bowstring 120 may be drawn rearward to a full draw position, thereby partially unraveling the bowstring 120 from the outer grooves of the cam assemblies 116, 118. The archer may grasp the grip 108 of the riser 102 and draw back the bowstring 120 (e.g., by using a D-loop, not shown). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110.

When the bowstring 120 is released, the potential/stored energy in the limbs 104, 106 is released, and the bowstring 120 quickly accelerates back toward the brace position (shown in FIG. 1A) as it applies a shooting force to an end of the projectile (e.g., an arrow). As the limbs 104, 106 release their energy, the cam assemblies 116, 118 are spread apart, and the terminal ends of the bowstring 120 wrap around the cam assemblies 116, 118, and the cables 122, 124 unwind from the cam assemblies 116, 118. A portion of the bowstring 120 may contact the string-stop damper 112, which can help dampen vibrations in the bowstring 120, and the cables 122, 124 may roll or slide against the cable guard 110 as the cam assemblies 116, 118 move.

Figure 1B:
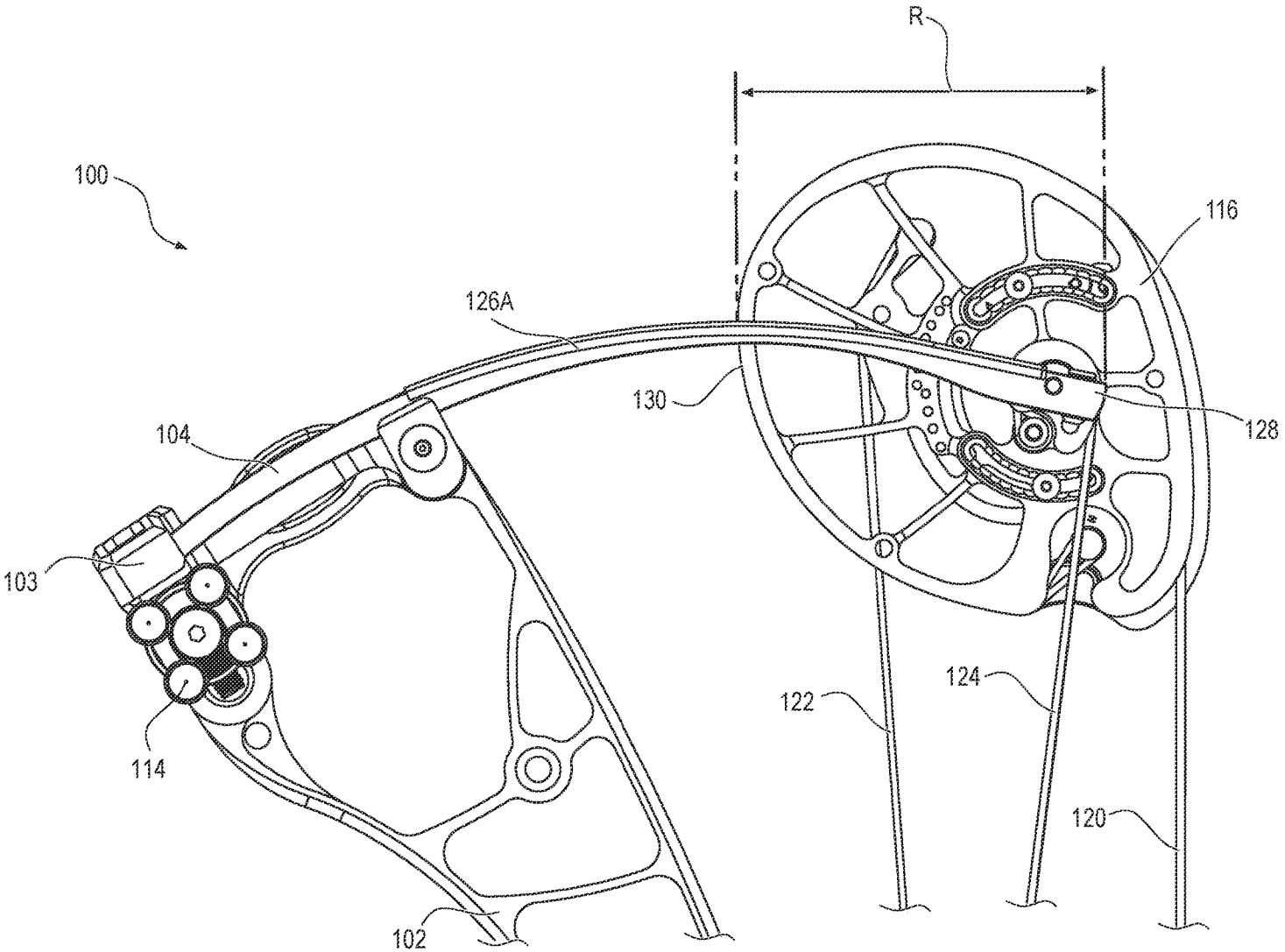
FIG. 1B is a detail side view of the archery bow, according to some embodiments.
Figure 1C:
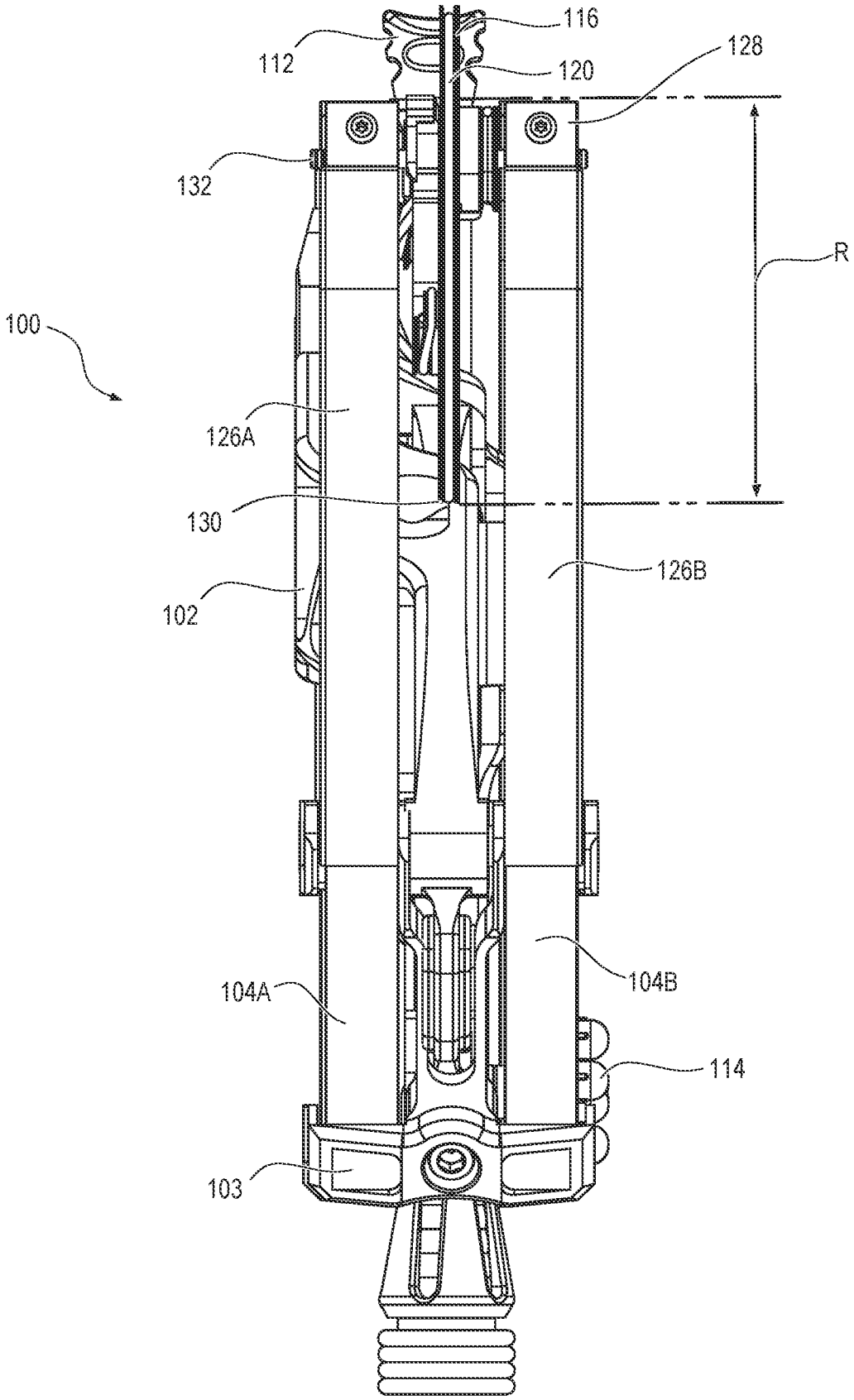
FIG. 1C is a top view of the archery bow, according to some embodiments.

As shown in FIGS. 1A-1C, in some examples, the bow 100 can include one or more cover members 126A, 126B, 126C coupled to one or more of the upper limbs 104 and/or one or more of the lowers limbs 106. FIGS. 1B and 1C show detail views of the bow 100 including the cover member 126A affixed or otherwise coupled to one of the upper limbs 104. Although the lower limbs 106 are not shown in detail, each of the lower limbs 106 can have a respective cover member affixed thereto. While the bow 100 is depicted as a split-limb bow having multiple upper limbs 104 and multiple lower limbs 106, aspects of this disclosure are equally applicable to archery bows having a single upper limb and a single lower limb. Likewise, aspects of this disclosure are equally applicable to bows having more than two upper limbs and more than two lower limbs.

In some examples, the cover member (e.g., the cover member 126A, the cover member 126B) can be at least partially disposed on a region R of the limb (e.g., one of the upper limbs 104, one of the lower limbs 106) that is laterally adjacent to the cam (e.g., the upper cam assembly 116, the lower cam assembly 118). In other words, one or more cover members can be disposed on surfaces of the limb that are disposed to the side of the cam such that the cover members are at least partially disposed on regions of the limb that move the most when a projectile is launched from the archery bow. For example, as shown in FIGS. 1B and 1C, the region R can be defined or formed between a distal end 128 of the upper limb 104 and a periphery 130 of the upper cam assembly 116. In some examples, the region R can be defined or formed between an axle 132 or fastener extending through the upper limb 104 and a periphery 130 of the upper cam assembly 116. In some examples, the region R can include a singular surface of the limb 104, such as, a tensile surface of the limb 104 (see tensile surface 304 of FIG. 3A). In some examples, the region R can include multiple surfaces of the limb 104, such as, a tensile surface, a compression surface, one or more lateral surfaces, or a combination thereof (see surfaces 304, 306, 208 in FIGS. 3A and 3B). In some examples, a majority or entirety of the cover member 126A can be disposed on or within the region R.

While the cover members 126A, 126B, 126C are illustrated as being affixed or disposed on respective tensile surfaces of the upper and lower limbs 104, 106, each of the cover members 126A, 126B, 126C can be affixed to respective tensile surfaces, respective compression surfaces, respective lateral surfaces, or combinations thereof in some examples. For example, one or more of the cover members 126A, 126B, 126C can cover or extend over at least a portion of the tensile surface and a lateral surface of an archery limb (e.g., one of the upper limbs 104 or the lower limbs 106). One or more of the cover members 126A, 126B, 126C can be at least partially disposed on a region of the limb (e.g., upper limbs 104 or lower limbs 106) that is laterally adjacent to the cam (e.g., upper cam assembly 116 or lower cam assembly 118). Placement of a cover member on an archery bow limb and other characteristics of a cover member will be discussed in further detail herein with reference to FIGS. 2A-5B.

Figure 2A:
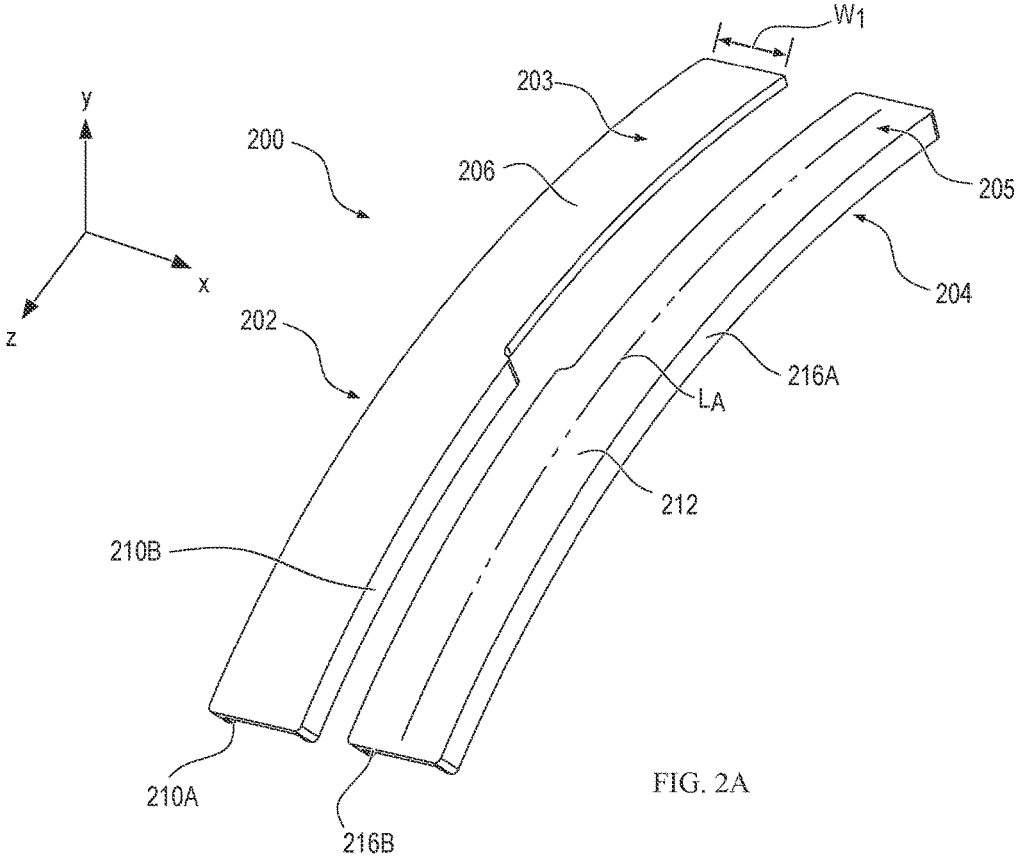
FIG. 2A is a perspective top view of cover members for archery bow limbs, according to some embodiments.
Figure 2B:
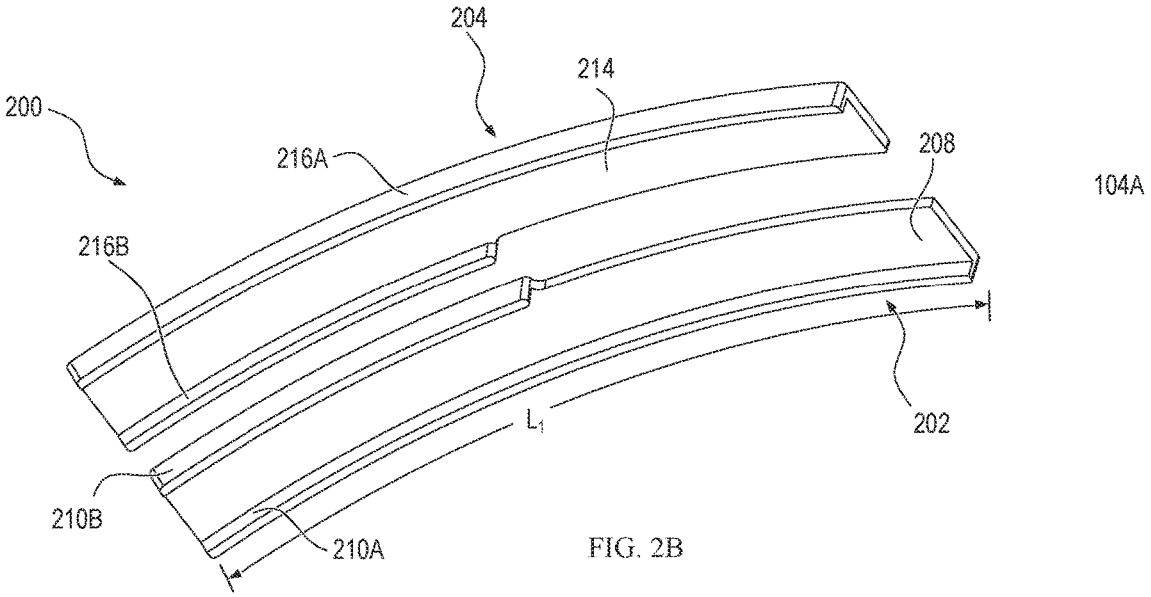
FIG. 2B is a perspective bottom view of cover members for archery bow limbs, according to some embodiments.

FIGS. 2A and 2B show a pair of cover members 200 including a first cover member 202 and a second cover member 204. The first and second cover members 202, 204 can be substantially similar to, and can include some or all of, the features of the cover members 126A, 126B, 126C. For example, the first cover member 202 and the second cover member 204 can be disposed on respective limbs as shown in FIG. 1B (e.g., upper limbs 104). The first and second cover members 202, 204 can be printed, molded, machined, stamped, or otherwise formed from polymers, composites, metals, or a combination thereof. For example, one or more of the first and second cover members 202, 204 can include a polymer-based foam having a density that is less than a density of the archery bow limb. In some examples, one or more of the first and second cover members 202, 204 can include a material that provides sound absorption to reduce or diffuse energy (e.g., acoustic waves) generated when a projectile is launched from the archery bow. In some examples, one or more of the first and second cover members 202, 204 can be molded from a semi-deformable rubber, such as, a thermoplastic elastomer. In some examples, the cover members 202, 204 can be at least partially formed from a Non-Newtonian material.

The first cover member 202 can include a body 203 having an external-facing surface 206 and a limb-facing surface 208. In some examples, a thickness of the body 203 can vary over a length of the body 203. In some examples, the external-facing surface 206 can extend parallel to, or substantially parallel to, the limb-facing surface 208. In some examples, the external-facing surface 206 can include a region having a plurality of protrusions extending therefrom (see FIGS. 6A-6F). In some examples, at least a portion of the external-facing surface 206 can be machined, blasted, etched, or otherwise formed to define a pattern or surface texture.

In some examples, one or more surfaces (e.g., the external-facing surface 206, the limb-facing surface 208, etc.) of the pair of cover members 200 can be characterized as planar or substantially planar, meaning the one or more surfaces of the archery bow limb can be characterized as a smooth plane curve (e.g., a plane curve that can be mapped to a line by a smooth function). For example, one or more of the surfaces (e.g., the external-facing surface 206, the limb-facing surface 208, etc.) can be substantially flat, smooth, and/or featureless. In some examples, the one or more surfaces can be concentric or otherwise define a flat surface that extends in a curved arc about a radial center (e.g., while the archery bow limb is under load in a brace or drawn state). For example, one or more of the external-facing surface 206 and the limb-facing surface 208 can be planar along one direction (e.g., the x-direction) and curve along another direction (e.g., the z-direction).

While the external-facing surface 206 is shown as substantially planar in FIG. 2A, the external-facing surface 206 can be non-planar or otherwise have non-planar portions in other examples (see FIGS. 6B-6F). For example, the external-facing surface 206 can be formed from multiple discrete surfaces that extend non-parallel to the limb-facing surface 208, such as, multiple discrete surfaces that intersect to form angles between the surfaces.

In some examples, an adhesive layer, such as, an adhesive tape can be disposed on at least a portion of the limb-facing surface 208 to affix the first cover member 202 to an archery bow limb (e.g., one of the upper limbs 104 or the lower limbs 106). While the limb-facing surface 208 is shown as substantially planar in FIG. 2B, the limb-facing surface 208 can be non-planar in other examples. For example, the limb-facing surface 208 can define or form a channel or one or more recesses to at least partially receive and locate the adhesive layer on the limb-facing surface 208.

In some examples, the first cover member 202 can be part of a laminated archery bow limb. For example, the first cover member 202 can be integrally formed as one layer of a plurality of laminated layers that make up an archery bow limb. In some examples, the first cover member 202 can be laminated as an exterior surface or outermost surface of the archery bow limb. In some examples, the first cover member 202 can be laminated as an interior surface or a surface facing the handle portion or grip of the archery bow limb. In some examples, the archery bow limb can be laminated with respective cover members forming the exterior surface and the interior surface of the archery bow limb.

In some examples, the first cover member 202 can include one or more sidewalls, such as, a first sidewall 210A and a second sidewall 210B extending substantially perpendicular from the limb-facing surface 208. The first and second sidewalls 210A, 210B can extend along at least a portion of a length of the first cover member 202. For example, the first sidewall 210A can extend an entirety of the length while the second sidewall 210B can extend less than the entirety of the length. In some examples, the second sidewall 210B can be relatively shorter than the first sidewall 210A to accommodate a rotatable cam (e.g., the upper or lower cam assemblies 116, 118) disposed laterally adjacent to at least a portion of the first cover member 202 while the first cover member 202 is disposed on an archery bow limb. As such, a width $W_1$ of the first cover member 202 can vary over the length $L_1$ of the first cover member 202. In some examples, a combination of the first sidewall 210A, the second sidewall 210B, and/or the external-facing surface 206 can extend along at least a portion of one or more lateral edges of the archery bow limb. In some examples, one or both of the first sidewall 210A or the second sidewall 210B can define limb-facing surfaces that can be adhered, affixed, or otherwise disposed adjacent one or more lateral surfaces (e.g., first lateral surface 308, the second lateral surface 330) of the archery bow limb.

In some examples, the first cover member 202 can have a single sidewall (e.g., the first sidewall 210A or the second sidewall 210B). In some examples, the first cover member 202 may not include any sidewalls. In these examples, the external-facing surface 206 can: extend to the lateral edge of the archery bow limb; extend beyond the lateral edge of the archery bow limb; or terminate prior to the lateral edge of the archery bow limb.

The second cover member 204 can include a body 205 having an external-facing surface 212 and a limb-facing surface 214. In some examples, a thickness of the body 205 can vary over a length of the body 205. In some examples, the external-facing surface 212 can extend parallel to, or substantially parallel to, the limb-facing surface 214. In some examples, the external-facing surface 212 can include one or more protrusions extending therefrom (see FIGS. 6B-6F). In some examples, at least a portion of the external-facing surface 212 can be machined, blasted, etched, or otherwise formed to define a pattern or textured surface. While the external-facing surface 212 is shown as substantially planar in FIG. 2A, the external-facing surface 212 can be non-planar in other examples (see FIGS. 6B-6F). For example, the external-facing surface 212 can be formed from multiple discrete surfaces that extend non-parallel to the limb-facing surface 214, such as, multiple discrete surfaces that intersect to form angles between the surfaces.

In some examples, one or both of the cover members 202, 204 can include a pattern having a plurality of protrusions (see FIGS. 6B-6F). The pattern can extend along one or more surfaces of the cover member in multiple directions, such as, a first direction and a second direction. For example, the pattern can be formed within or on the external-facing surface 212 and extend transverse (e.g., along the x-direction) to a longitudinal axis $L_A$ of the body 205 and also extend parallel (e.g., along the z-direction) to the longitudinal axis $L_A$. Additionally, or alternatively, the pattern can extend along a first sidewall 216A of the cover member 204, such as, extending transverse (e.g., along the y-direction) to a longitudinal axis $L_A$ of the body 205.

In some examples, an adhesive layer, such as, an adhesive tape can be disposed on at least a portion of the limb-facing surface 214 to affix the second cover member 204 to an archery bow limb (e.g., one of the upper limbs 104 or the lower limbs 106). While the limb-facing surface 214 is shown as substantially planar in FIG. 2B, the limb-facing surface 214 can be non-planar in other examples. For example, the limb-facing surface 214 can define or form a channel or one or more recesses to at least partially receive and locate the adhesive layer on the limb-facing surface 214.

In some examples, the second cover member 204 can include one or more sidewalls, such as, the first sidewall 216A and a second sidewall 216B extending substantially perpendicular from the limb-facing surface 214. The first and second sidewalls 216A, 216B can extend along at least a portion of a length of the second cover member 204. For example, the first sidewall 216A can extend an entirety of the length while the second sidewall 216B can extend less than the entirety of the length. In some examples, the second sidewall 216B can be relatively shorter than the first sidewall 216A to accommodate a cam (e.g., the upper or lower cam assemblies 116, 118) disposed laterally adjacent to at least a portion of the second cover member 204 while the second cover member 204 is disposed on an archery bow limb. As such, a width of the second cover member 204 can vary over the length of the second cover member 204. In some examples, a combination of the first sidewall 216A, the second sidewall 216B, and/or the external-facing surface 212 can extend along at least a portion of one or more lateral edges of the archery bow limb.

In some examples, the second cover member 204 can have a single sidewall (e.g., the first sidewall 216A or the second sidewall 216B). In some examples, the second cover member 204 may not include any sidewalls. In these examples, the external-facing surface 212 can: extend to the lateral edge of the archery bow limb; extend beyond the lateral edge of the archery bow limb; or terminate prior to the lateral edge of the archery bow limb.

While the second cover member 204 is depicted as substantially mirroring the first cover member 202 (i.e., having features which mirror the first cover member 202), the first and second cover members 202, 204 can be dissimilar in some examples, such as, having differing features, widths, densities, lengths, thicknesses, a combination thereof, or any other differing characteristics. In some examples, the first and second cover members 202, 204 can be curved or otherwise have one or more non-linear longitudinal axes such that the first and second cover members 202, 204 conform to a curved profile of an archery bow limb while the archery bow is in a brace state or fully drawn state. In some examples, the first and second cover members 202, 204 can be linear or substantially linear yet flexible or semi-flexible to conform to a curved profile of an archery bow limb while the archery bow is in a brace state or fully drawn state.

Figure 3A:
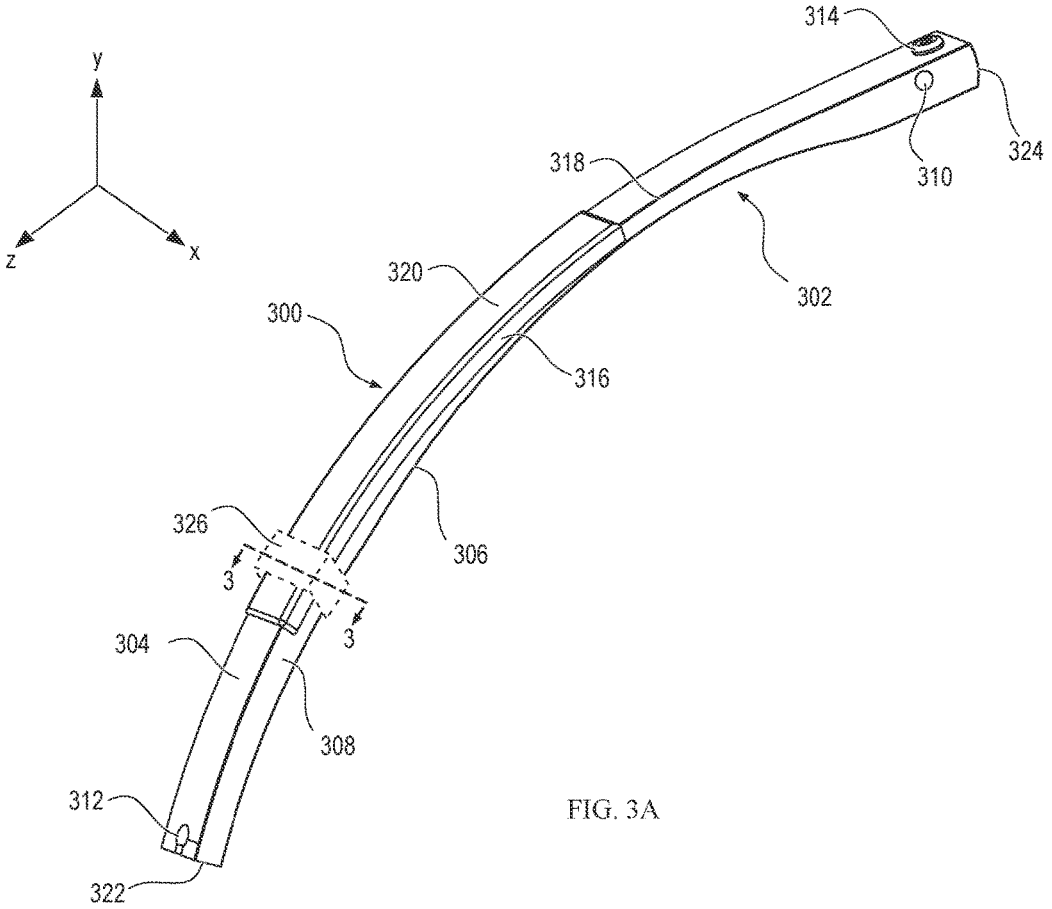
FIG. 3A is a perspective top view of a cover member on an archery bow limb in a first position, according to some embodiments.
Figure 3B:
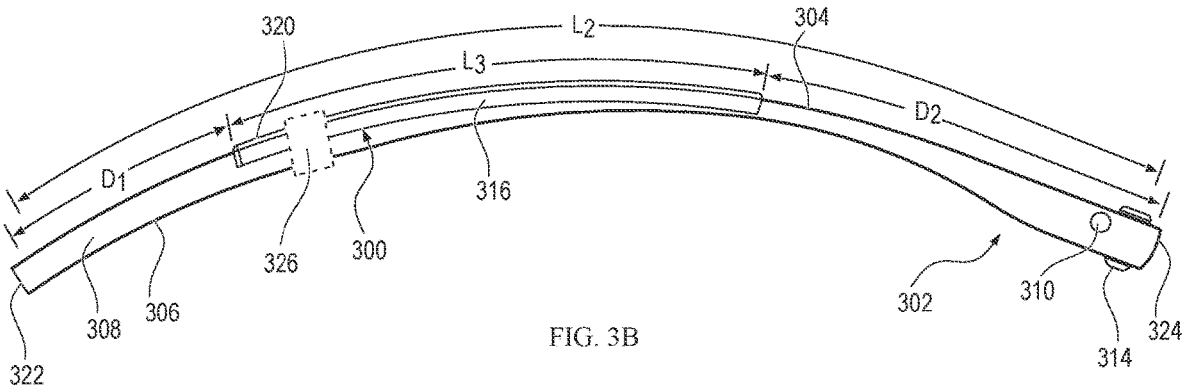
FIG. 3B is a side view of the cover member on the archery bow limb in the first position, according to some embodiments.

FIGS. 3A and 3B show a cover member 300 disposed at a first position on an archery bow limb 302. In some examples, the archery bow limb 302 can include a tensile surface 304, a compression surface 306, a first lateral surface 308, and a second lateral surface 330. The compression surface 306 can be disposed opposite of the tensile surface 304. The first lateral surface 308 can extend parallel to the second lateral surface 330. The cover member 300 can be disposed on one or more of the tensile surface 304, the compression surface 306, the first lateral surface 308, and/or the second lateral surface 330. For example, as shown in FIGS. 3A and 3B, the cover member 300 can be disposed on the tensile surface 304 of the archery bow limb 302. In some examples, the cover member 300 can be disposed on the compression surface 306 of the archery bow limb 302 (see FIGS. 5A and 5B). In some examples, the cover member 300 can be disposed on the tensile surface 304, the compression surface 306, and at least one of the first and second lateral surfaces to at least partially envelop a portion of the archery bow limb 302.

In some examples, the archery bow limb 302 can include a through-hole 310 for receiving an axle or other component configured to enable a cam assembly to be rotatably affixed to the archery bow limb 302. In some examples, the archery bow limb 302 can include a feature 312 configured to engage with a limb pocket to retain the archery bow limb 302 within the limb pocket. In some examples, the archery bow limb 302 can include one or more fasteners 314 extending at least partially through the archery bow limb 302.

The cover member 300 can be substantially similar to, and can include, some or all of, the features of the cover members 126A, 126B, 126C, 202, 204. For example, the cover member 300 can include a sidewall 316 extending along a portion of the first lateral surface 308 of the archery bow limb 302 such that the cover member 300 is disposed along a lateral edge 318 of the archery bow limb 302. In some examples, an external-facing surface 320 and/or the sidewall 316 can have a texture or otherwise include one or more protrusions extending therefrom (see FIGS. 6B-6F).

In some examples, the archery bow limb 302 can have a second length $L_2$ and the cover member 300 can have a third length $L_3$. In some examples, the second length $L_2$ of the archery bow limb 302 can be less than about 10 centimeters (cm), between about 10 cm and about 20 cm, between about 20 cm and about 30 cm, between about 30 cm and about 40 cm, or greater than about 40 cm. In some examples, the third length $L_3$ of the cover member 300 can be less than about 5 centimeters (cm), between about 5 cm and about 15 cm, between about 15 cm and about cm, or greater than about 30 cm. In some examples, the second length $L_2$ and the third length $L_3$ can form a ratio. For example, the second length $L_2$ can be five times the third length $L_3$ to form a ratio of about 5:1. The ratio defined by the second length $L_2$ relative to the third length $L_3$ can be about 1:1, between about 1:1 and about 1.5:1, between about 1.5:1 and about 2:1, between about 2:1 and about 3:1, between about 3:1 and about 4:1, between about 4:1 and about 5:1, equal to or less than 5:1, or greater than 5:1.

The archery bow limb 302 can include a proximal end 322 and a distal end 324. The proximal end 322 can be configured to be affixed a bow riser or handle via a limb pocket. The cover member 300 can be disposed between the proximal and distal ends 322, 324. For example, as shown in FIG. 3B, the cover member 300 can be affixed to the archery bow limb 302 at a first distance $D_1$ from the proximal end 322 and a second distance $D_2$ from the distal end 324. The first distance $D_1$ that the cover member 300 is displaced from the proximal end 322 of the archery bow limb 302 can be less than about 2 centimeters (cm), between about 2 cm and about 5 cm, between about 5 cm and about 10 cm, between about 10 cm and about 15 cm, between about 15 cm and about 20 cm, or greater than about 20 cm. The second distance $D_2$ that the cover member 300 is displaced from the distal end 324 of the archery bow limb 302 can be less than about 2 centimeters (cm), between about 2 cm and about 5 cm, between about 5 cm and about 10 cm, between about cm and about 15 cm, between about 15 cm and about 20 cm, or greater than about 20 cm. In some examples, the cover member 300 can be disposed closer to the proximal end 322 than the distal end 324 such that the second distance $D_2$ is relatively larger than the first distance $D_1$.

In some examples, a retaining member 326 can engage the cover member 300 to couple the cover member 300 to the archery bow limb 302. The retaining member 326 can be a clamp, a fastener, a sleeve, a tape, a clip, a combination thereof, or any other component capable of retaining the cover member 300 in a fixed position on the archery bow limb 302 while a projectile is launched from the archery bow. In some examples, the retaining member 326 can be removably affixed about the cover member 300. For example, the retaining member 326 can be a clamp or clip (see FIG. 3C) configured to apply a clamping force on the cover member 300. In some examples, the retaining member 326 can be more permanently affixed to the cover member 300, such as, a sleeve (see FIG. 3D) forming a channel or opening which the archery bow limb 302 and at least a portion of the cover member 300 can be inserted. For example, the sleeve can be configured to shrink and conform around a periphery of the cover member 300 and the archery bow limb 302 when heat is applied to the sleeve. These non-limiting examples of the retaining member 326 are described in further detail herein with reference to FIGS. 3C and 3D.

While FIGS. 3A-3D illustrate a singular retaining member 326, one or more retaining members 326 can be disposed anywhere along a length $L_3$ of the cover member 300. For example, the cover member 300 can be affixed to the archery bow limb 302 by a plurality of retaining members 326. Additionally, or alternatively, the cover member 300 can be at least partially affixed to one or more surfaces of the archery bow limb 302 by an adhesive layer, such as, an adhesive tape.

Figure 3C:
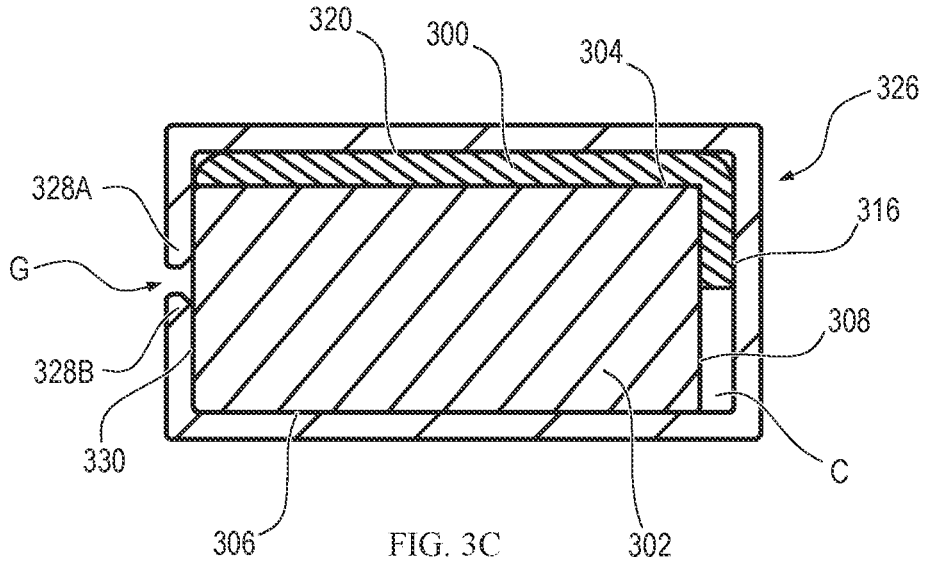
FIG. 3C is a cross-sectional front view of the cover member on the archery bow limb through lines 3-3 shown in FIG. 3A, according to some embodiments.

FIG. 3C shows an example cross-section view of the cover member 300, the archery bow limb 302, and the retaining member 326 through lines 3-3 shown in FIG. 3A. In some examples, the retaining member 326 can act as a clamp or clip disposed around a portion of the periphery defined by the cover member 300 and the archery bow limb 302 and applying a compressive force on the cover member 300 to couple the cover member 300 to one or more surfaces of the archery bow limb 302. For example, the retaining member 326 can contact at least one surface (e.g., external-facing surface 320) of the cover member 300 and at least one surface (e.g., compression surface 306) of the archery bow limb 302. In some examples, the retaining member 326 can contact more than one surface (e.g., external-facing surface 320, sidewall 316) of the cover member 300 and/or more than one surface (e.g., compression surface 306, tensile surface 304, first lateral surface 308, second lateral surface 330) of the archery bow limb 302.

In some examples, the retaining member 326 can include end portions 328A, 328B that can be displaced from one another to install or remove the retaining member 326 from cover member 300 and archery bow limb 302 without requiring disassembly of the archery bow. The end portions 328A, 328B can be displaced from one another by a gap G. The gap G can be a first size while the retaining member 326 engages the cover member 300 and archery bow limb 302. The gap G can be a second size that is greater than the first size when the end portions are biased away from one another while installing or removing the retaining member 326 onto the cover member 300 and the archery bow limb 302. In some examples, the retaining member 326 can at least partially form or define a volume or cavity C between the retaining member 326 and at least one of the cover member 300 and the archery bow limb 302. In some examples, the retaining member 326 can be molded, formed, pressed, or otherwise manufactured to conform to a periphery defined by the cover member 300 and the archery bow limb 302.

Figure 3D:
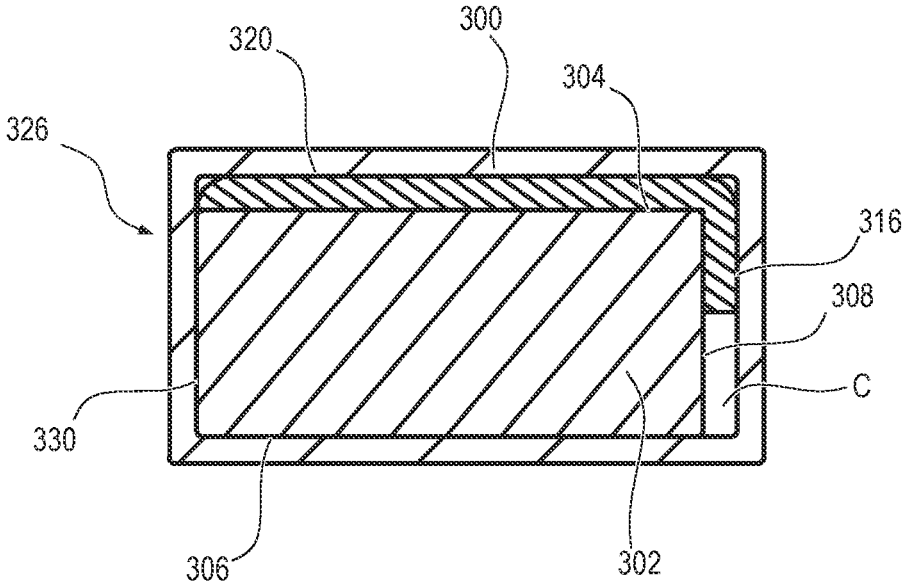
FIG. 3D is a cross-sectional front view of the cover member on the archery bow limb through lines 3-3 shown in FIG. 3A, according to some embodiments.

FIG. 3D shows another example cross-section view of the cover member 300, the archery bow limb 302, and the retaining member 326 through lines 3-3 shown in FIG. 3A. In some examples, the retaining member 326 can be a jacket or sleeve disposed around a periphery defined by the cover member 300 and the archery bow limb 302 and applying a compressive force on the cover member 300 to couple the cover member 300 to the archery bow limb 302. For example, the retaining member 326 can be a fabric that shrinks and conforms to the periphery when heat is applied to the retaining member 326. The retaining member 326 can contact one or more surfaces (e.g., external-facing surface 320, sidewall 316) of the cover member 300 and/or one or more surfaces (e.g., compression surface 306, tensile surface 304, first lateral surface 308, second lateral surface 330) of the archery bow limb 302. In some examples, the retaining member 326 can at least partially form or define a volume or cavity C between the retaining member 326 and at least one of the cover member 300 and the archery bow limb 302. In some examples, the retaining member 326 can be molded, formed, pressed, shrunk, or otherwise manufactured to conform to a periphery defined by the cover member 300 and the archery bow limb 302.

Figure 4A:
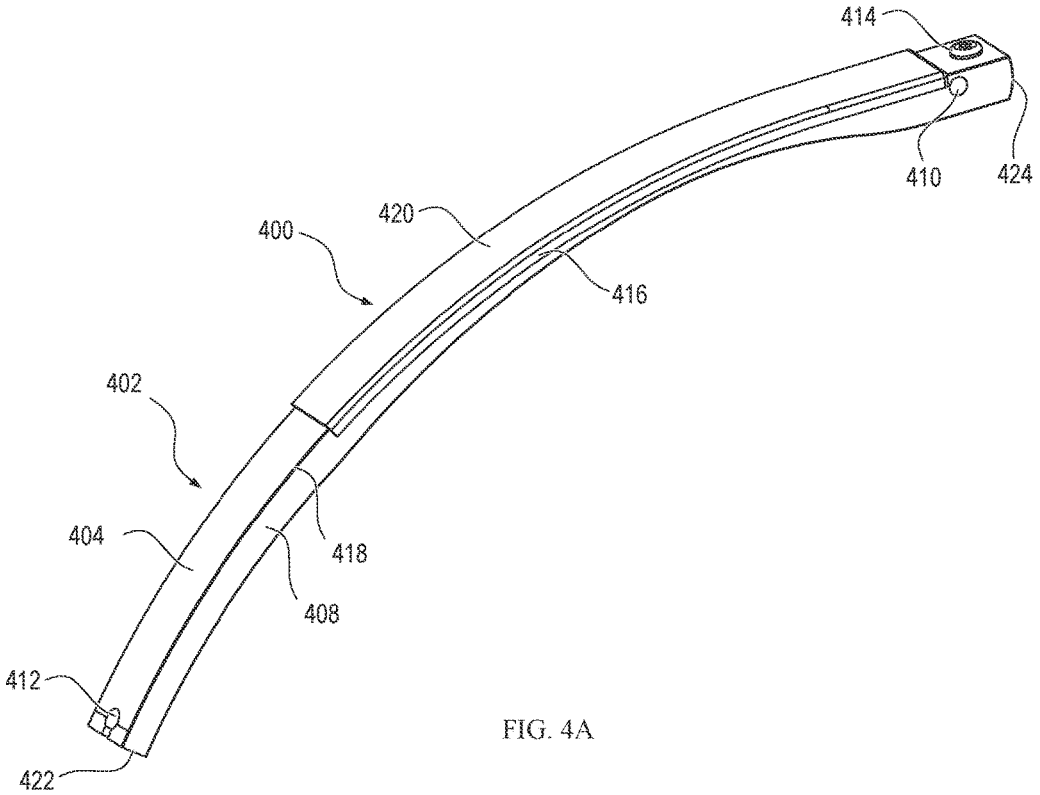
FIG. 4A is a perspective top view of a cover member on an archery bow limb in a second position, according to some embodiments.
Figure 4B:
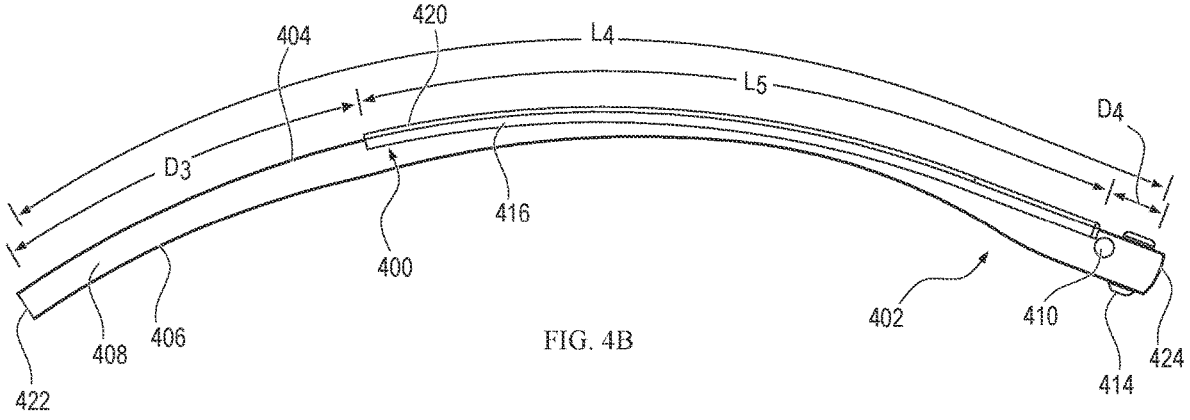
FIG. 4B is a side view of the cover member on the archery bow limb in the second position, according to some embodiments.

FIGS. 4A and 4B show a cover member 400 disposed at a second position on an archery bow limb 402. In some examples, the archery bow limb 402 can be substantially similar to, and include some or all of the features of the archery bow limb 302. For example, the archery bow limb 402 can include a tensile surface 404, a compression surface 406, a first lateral surface 408, and a second lateral surface. The cover member 400 can be disposed on one or more of the tensile surface 404, the compression surface 406, the first lateral surface 408, and/or the second lateral surface. For example, as shown in FIGS. 4A and 4B, the cover member 400 can be disposed on the tensile surface 404 of the archery bow limb 402. In some examples, the cover member 400 can be disposed on the compression surface 406 of the archery bow limb 402. In some examples, the cover member 400 can be disposed on the tensile surface 404, the compression surface 406, and at least one of the first and second lateral surfaces to at least partially envelop a portion of the archery bow limb 402, for example, the cover member 400 can be adhered, laminated, molded, fastened, to the archery bow limb 402. While a retaining member (e.g., retaining member 326) is not illustrated in FIGS. 4A-5B, the descriptions of the retaining member 326 herein are equally applicable to the example cover members 400, 500 shown in FIGS. 4A-5B.

In some examples, the archery bow limb 402 can include a through-hole 410 for receiving an axle or other component configured to enable a cam assembly to be rotatably affixed to the archery bow limb 402. In some examples, the archery bow limb 402 can include a feature 412 configured to engage with a limb pocket to retain the archery bow limb 402 within the limb pocket. In some examples, the archery bow limb 402 can include one or more fasteners 414 extending at least partially through the archery bow limb 402.

In some examples, the cover member 400 can be disposed at the distal end 424 of the archer bow limb 402 and the fastener 414 can extend through the cover member 400 into the archery bow limb 402 to couple the cover member 400 to the archery bow limb 402. For example, the fastener 414 can be part of a limb hanger assembly and the cover member 400 can be disposed between the limb hanger assembly and the tensile surface 404. The cover member 400 can include one or more apertures and the one or more fasteners 414 can extend through the one or more apertures of the cover member 400.

The cover member 400 can be substantially similar to, and can include some or all of, the features of the cover members 126A, 126B, 126C, 202, 204, 300. For example, the cover member 400 can include a sidewall 416 extending along a portion of the first lateral surface 408 of the archery bow limb 402 such that the cover member 400 is disposed along a lateral edge 418 of the archery bow limb 402. In some examples, an external-facing surface 420 and/or the sidewall 416 can have a texture or otherwise include one or more protrusions extending therefrom (see FIGS. 6B-6F).

In some examples, the archery bow limb 402 can have a fourth length $L_4$ and the cover member 400 can have a fifth length $L_5$. In some examples, the fourth length $L_4$ of the archery bow limb 402 can be less than about 10 centimeters (cm), between about 10 cm and about 20 cm, between about 20 cm and about 30 cm, between about 30 cm and about 40 cm, or greater than about 40 cm. In some examples, the fifth length $L_5$ of the cover member 400 can be less than about 5 centimeters (cm), between about 5 cm and about 15 cm, between about 15 cm and about 30 cm, or greater than about 30 cm. In some examples, the fourth length $L_4$ and the fifth length $L_5$ can form or define a ratio. For example, the fourth length $L_4$ can be five times the fifth length $L_5$ to form a ratio of about 5:1. The ratio defined by the fourth length $L_4$ relative to the fifth length $L_5$ can be about 1:1, between about 1:1 and about 1.5:1, between about 1.5:1 and about 2:1, between about 2:1 and about 3:1, between about 3:1 and about 4:1, between about 4:1 and about equal to or less than 5:1, or greater than 5:1.

The archery bow limb 402 can include a proximal end 422 and a distal end 424. The proximal end 422 can be configured to be affixed a bow riser or handle via a limb pocket. The cover member 400 can be disposed between the proximal and distal ends 422, 424. For example, as shown in FIG. 4B, the cover member 400 can be affixed to the archery bow limb 402 at a third distance $D_3$ from the proximal end 422 and a fourth distance $D_4$ from the distal end 424. In some examples, at least a portion of the cover member 400 can be disposed on or within a region of the limb 402 that is laterally adjacent a cam (see region R in FIGS. 1B and 1C).

The third distance $D_3$ that the cover member 400 is displaced from the proximal end 422 of the archery bow limb 402 can be less than about 2 centimeters (cm), between about 2 cm and about 5 cm, between about 5 cm and about 10 cm, between about 10 cm and about 15 cm, between about 15 cm and about 20 cm, or greater than about 20 cm. The fourth distance $D_4$ that the cover member 400 is displaced from the distal end 424 of the archery bow limb 402 can be less than about 2 centimeters (cm), between about 2 cm and about 5 cm, between about 5 cm and about 10 cm, between about 10 cm and about 15 cm, between about 15 cm and about 20 cm, or greater than about 20 cm. In some examples, the cover member 400 can be disposed closer to the distal end 424 than the proximal end 422 such that the third distance $D_3$ is relatively larger than the fourth distance $D_4$.

Figure 5A:
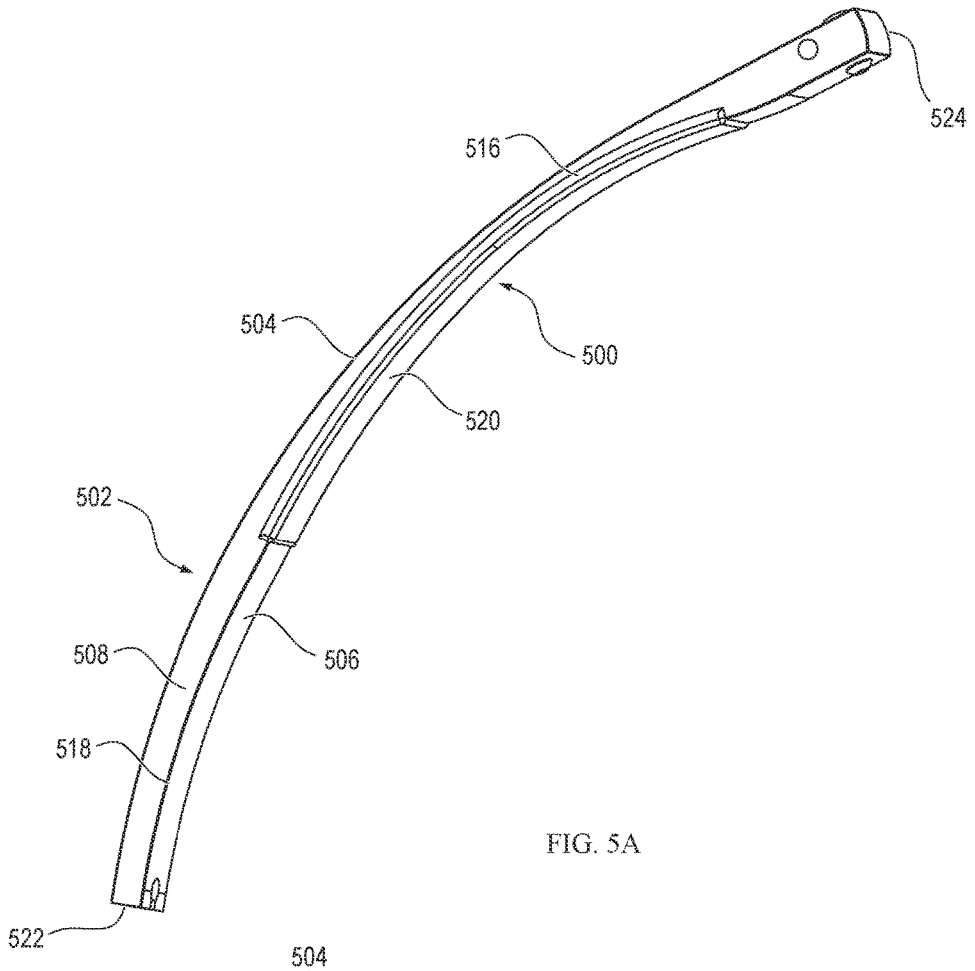
FIG. 5A is a perspective bottom view of a cover member on an archery bow limb in a third position, according to some embodiments.
Figure 5B:
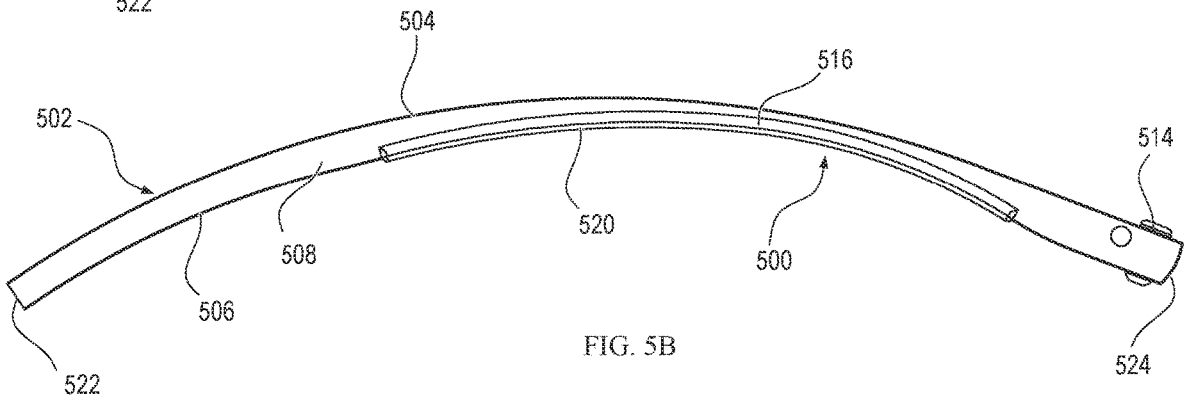
FIG. 5B is a side view of the cover member on the archery bow limb in the third position, according to some embodiments.

While FIGS. 3A-4B illustrate the cover members 300, 400 affixed to respective tensile surfaces 304, 404 of the archery bow limbs 302, 402, one or more additional, or alternative, cover members can be affixed to other surfaces of the archery bow limb. For example, as shown in FIGS. 5A and 5B, a cover member 500 can be affixed or otherwise coupled to a compression surface 506 of an archery bow limb 502. In some examples, the archery bow limb 502 can be substantially similar to, and include some or all of the features of the archery bow limbs 302, 402. For example, the archery bow limb 502 can include a tensile surface 504, the compression surface 506, a first lateral surface 508, and a second lateral surface. The cover member 500 can be substantially similar to, and can include some or all of, the features of the cover members 126A, 126B, 126C, 202, 204, 300, 400. For example, the cover member 500 can include a sidewall 516 extending along a portion of the first lateral surface 508 of the archery bow limb 502 such that the cover member 500 is disposed along a lateral edge 518 of the archery bow limb 502. In some examples, an external-facing surface 520 and/or the sidewall 516 can have a texture or otherwise include one or more protrusions extending therefrom (see FIGS. 6B-6F).

The archery bow limb 502 can include a proximal end 522 and a distal end 524. The proximal end 522 can be configured to be affixed a bow riser or handle via a limb pocket. The cover member 500 can be disposed between the proximal and distal ends 522, 524. In some examples, the cover member 500 can be affixed to the compression surface 506 some distance (e.g., the first distances $D_1$ or the third distance D 3) from the proximal end 522 of the archery bow limb 502. In some examples, the cover member 500 can be affixed to the compression surface 506 some distance (e.g., the second distances $D_2$ or the fourth distance D 4) from the distal end 524 of the archery bow limb 502. For example, as shown in FIGS. 5A and 5B, the cover member 500 can be affixed or coupled to the archery bow limb 502 relatively closer to the distal end 524 than the proximal end 522. In some examples, the cover member 500 can be affixed or coupled to the archery bow limb 502 relatively closer to the proximal end 522 than the distal end 524. The archery bow limb 502 can have an associated length (e.g., the second length $L_2$ or the fourth length L 4) and the cover member 500 can have an associated length (e.g., the third length $L_3$ or the fifth length L 5). The associated lengths of the archery bow limb 502 and the cover member 500 can form or define a ratio, such as, one or more of the ratios described herein with reference to FIGS. 3A-4B.

In some examples, the cover member 500 can be disposed at the distal end 524 of the archer bow limb 502 and one or more fasteners 514 can extend through the cover member 500 into the archery bow limb 502 to couple the cover member 500 to the archery bow limb 502. For example, the fastener 514 can extend completely through the archery bow limb 502 and the cover member 500 can be disposed between the compression surface 506 and a head or a nut associated with the fastener 514. The cover member 500 can include one or more apertures and the one or more fasteners 514 can extend through the one or more apertures of the cover member 500.

Figure 6A:
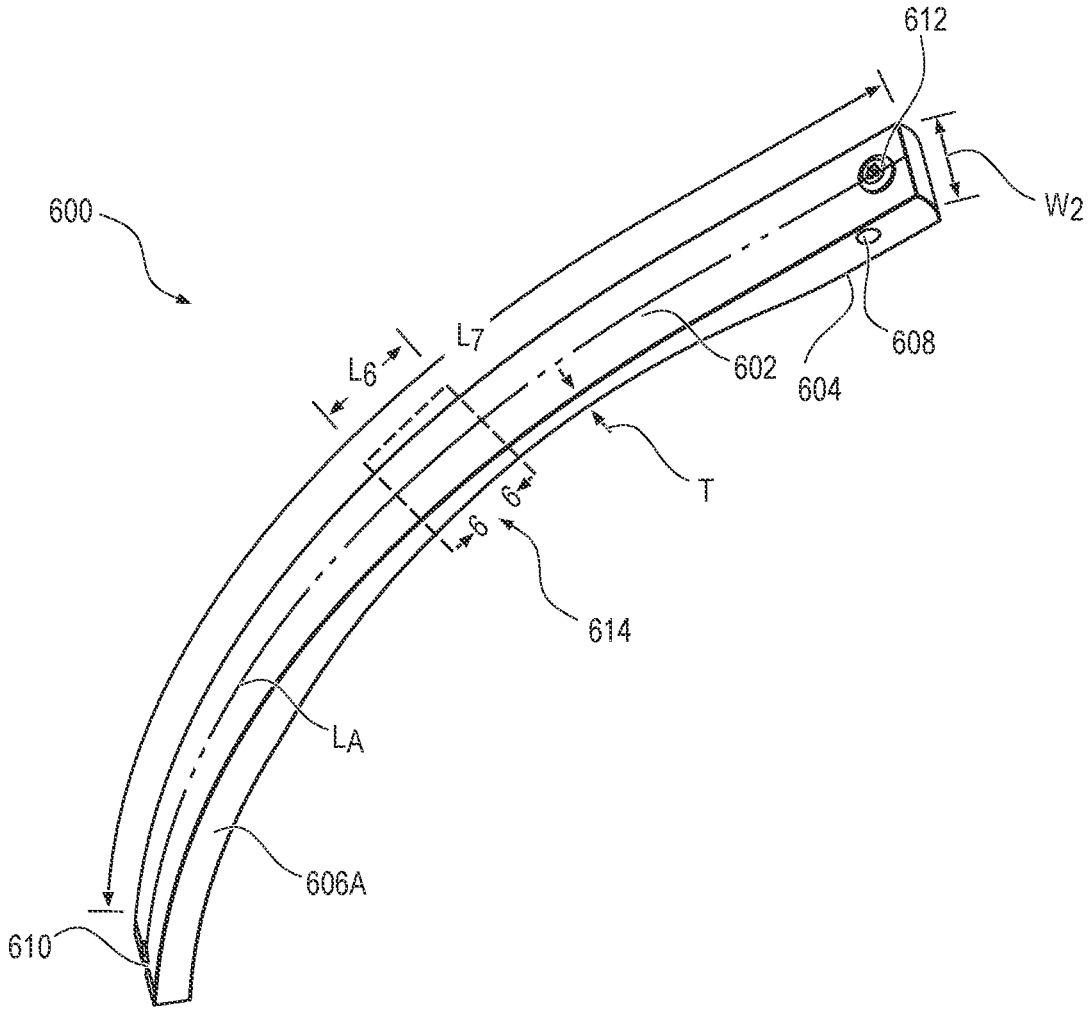
FIG. 6A is a perspective top view of an archery bow limb, according to some embodiments.

FIG. 6A shows an archery bow limb 600 including a tensile surface 602, a compression surface 604, a first lateral surface 606A, and a second lateral surface 606B (see FIGS. 6B-6F). In some examples, the archery bow limb 600 can include one or more through-holes 608 for receiving an axle or other component configured to enable a cam assembly to be rotatably affixed to the archery bow limb 600. In some examples, the archery bow limb 600 can include a feature 610 configured to engage with a limb pocket to retain the archery bow limb 600 within the limb pocket. In some examples, the archery bow limb 600 can include one or more fasteners 612 extending at least partially through the archery bow limb 600.

In some examples, one or more of the tensile surface 602, the compression surface 604, the first lateral surface 606A, and the second lateral surface 606B can include one or more protrusions or features forming a surface texture. For example, one or more protrusions can form a repeating or random pattern disposed on one or more surfaces of the archery bow limb 600. FIGS. 6B-6F show the archery bow limb 600 through section-line 6-6 having various examples of a surface texture formed from a plurality of protrusions. In some examples, at least a portion of the plurality of protrusions can be formed from a polymer, such as, a thermoplastic elastomer having a durometer correlating to a desired benefit. For example, particular durometers or ranges of durometers can correlate to vibration damping, noise cancelation, impact distribution, a combination thereof, or other desirable attributes of the plurality of protrusions. In some examples, one or more of the plurality of protrusions can be formed from a Non-Newtonian material. In some examples, one or more of plurality of protrusions can include a material that provides sound absorption to reduce or diffuse energy (e.g., acoustic waves) generated when a projectile is launched from the archery bow. As such, the plurality of protrusions can maximize non-flat surface area on one or more surfaces of the limb 600 to create greater spread of acoustic waves and improve acoustic diffusion. The plurality of protrusions can be integrally formed with the limb or subsequently formed or disposed on the archery bow limb 600.

While the plurality of protrusions are shown on the tensile surface 602 of the archery bow limb 600, the plurality of protrusions can be machined, adhered, disposed, etched, grown, or otherwise formed on additional, or alternative, surfaces (e.g., the compression surface 604, the first lateral surface 606A, and the second lateral surface 606B). While FIGS. 6B-6F show the archery bow limb 600 through section-line 6-6 having various examples of a surface texture formed from a plurality of protrusions, these examples should not be considered as limiting or restricting the present disclosure. Rather, the instant disclosure contemplates any repeating or non-repeating protrusions, protruding features, textures, or any other structure adhered, formed, or otherwise disposed on one or more archery bow limbs.

In some examples, the plurality of protrusions can extend along one or more surfaces of the archery bow limb 600 to define a ratio of a seventh length $L_7$ of the archery bow limb 600 relative to a sixth length $L_6$ the plurality of protrusions extend along the one or more surfaces. For example, the seventh length $L_7$ can be five times the sixth length $L_6$ to form a ratio of about 5:1. The ratio defined by the seventh length $L_7$ relative to the sixth length $L_6$ can be about 1:1, between about 1:1 and about 1.5:1, between about 1.5:1 and about 2:1, between about 2:1 and about 3:1, between about 3:1 and about 4:1, between about 4:1 and about 5:1, equal to or less than 5:1, or greater than 5:1.

While the plurality of protrusions are described herein with reference to FIGS. 6A-6F, the plurality of protrusions can alternatively, or additionally, be incorporated onto one or more surfaces of the cover members described herein with reference to FIGS. 1A-5B. For example, the plurality of protrusions can be formed, molded, adhered, or otherwise incorporated onto a region of the external-facing surface 206 of the first cover member 202 shown in FIGS. 2A and 2B. The region can make up less than one-quarter of the external-facing surface of the cover member, between about one-quarter and about one-half of the external-facing surface, between about one-half and about three-quarters of the external-facing surface, or greater than three-quarters of the external-facing surface of the cover member.

Figure 6B:
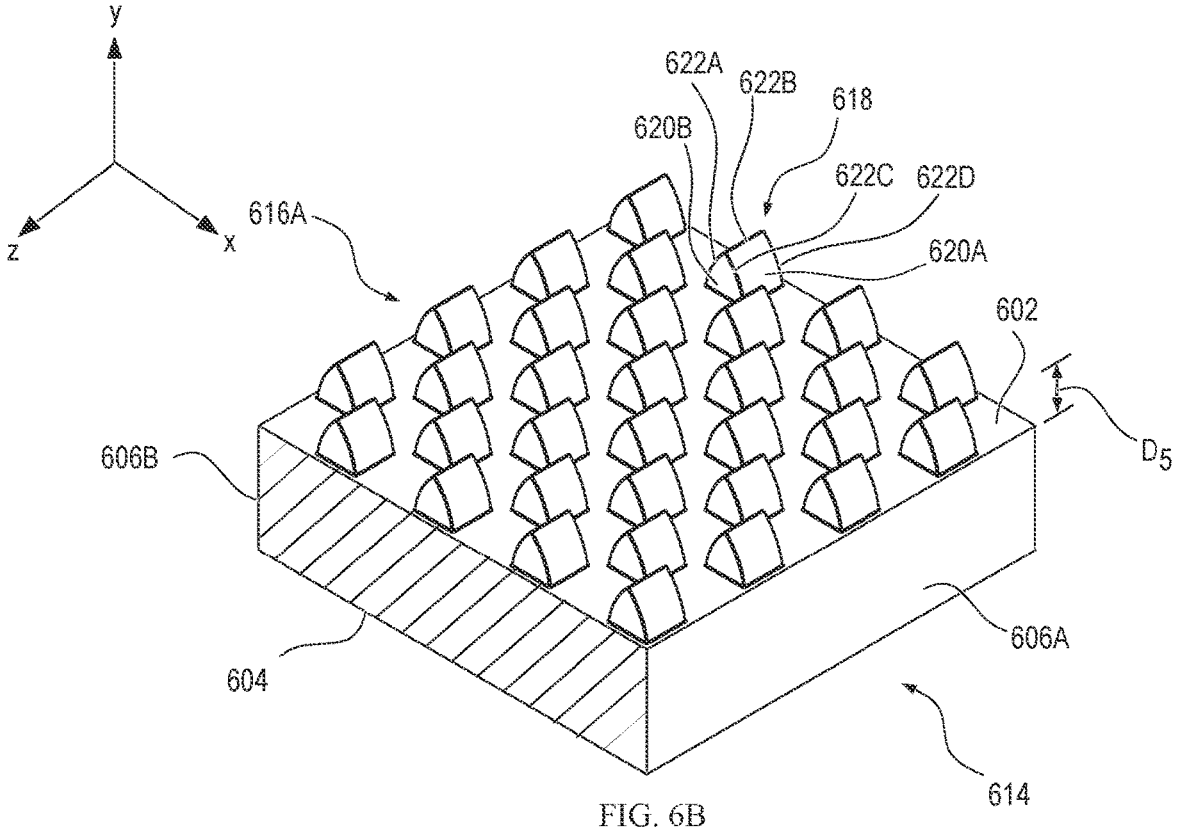
FIG. 6B is a perspective top view of an archery bow limb through section lines 6-6 shown in FIG. 6A, according to some embodiments.

FIG. 6B shows a section view of the archery bow limb 600 through the section lines 6-6 shown in FIG. 6A. More specifically, FIG. 6B shows the portion or region 614 of the tensile surface 602 having a pattern including a plurality of protrusions 616A formed on or within the tensile surface 602. The region 614 can extend at least a portion of a width $W_2$ of the archery bow limb 600. The pattern can repeat in one or more directions (e.g., the x-direction, the y-direction, the z-direction) in some examples. The pattern can extend along one or more surfaces of the limb in multiple directions, such as, a first direction and a second direction. For example, the pattern can be formed within or on the external-facing surface 602 and extend transverse (e.g., along the x-direction) to a longitudinal axis $L_A$ of the limb 600 and also extend parallel (e.g., along the z-direction) to the longitudinal axis $L_A$. Additionally, or alternatively, the pattern can extend along a first lateral surface 606A of the limb 600, such as, extending transverse (e.g., along the y-direction) to a longitudinal axis $L_A$ of the limb 600. In some examples, the pattern can extend in one or more directions (e.g., the x-direction, the y-direction, the z-direction) and can be nonrepeating or otherwise form a natural, random, or chance configuration on one or more surfaces of the limb 600.

The plurality of protrusions (e.g., plurality of protrusions 616A) can be defined or formed by any raised or recessed feature, such as, shapes, letters, text, symbols, channels, fins, another feature, or a combination thereof. While the region 614 is depicted as having a certain size relative to the tensile surface 602 of the archery bow limb 600, the region 614 can be defined by more or less of the tensile surface 602. For example, the region 614 can make up less than one-quarter of the tensile surface 602, between about one-quarter and about one-half of the tensile surface 602, between about one-half and about three-quarters of the tensile surface 602, or greater than three-quarters of the tensile surface 602.

The plurality of protrusions 616A can be adhered, etched, molded, sprayed, deposited, machined, grown, or otherwise disposed on one or more surfaces (e.g., the tensile surface 602, the compression surface 604, the first lateral surface 606A, and/or the second lateral surface 606B) of the archery bow limb 600. Each protrusion 618 of the plurality of protrusions 616A can extend from the respective surface (e.g., the tensile surface 602, the compression surface 604, the first lateral surface 606A, and/or the second lateral surface 606B). For example, the protrusion 618 can extend from the tensile surface 602 in the y-direction by a distance $D_5$. The distance $D_5$ can be less than about 5 millimeters (mm), between about 5 mm and about 10 mm, between about 10 mm and about 15 mm, between about 15 mm and about 20 mm, or greater than about 20 mm. In some examples, one or more protrusions of the plurality of protrusions 616A can extend a particular distance from the archery bow limb 600 and other protrusions of the plurality of protrusions 616A can extend a different distance from the archery bow limb 600. In other words, some of the protrusions of the plurality of protrusions 616A can extend dissimilar or differing distances from the archery bow limb 600 in some examples.

In some examples, each protrusion (e.g., a protrusion 618) of the plurality of protrusions 616A can define multiple discrete faces or surfaces 620A, 620B extending perpendicular or substantially perpendicular to the one or more surfaces the plurality of protrusions 616A are formed on (e.g., the tensile surface 602, the compression surface 604, the first lateral surface 606A, and/or the second lateral surface 606B). In some examples, one or more of the discrete faces or surfaces (e.g., the surface 620B) can be substantially flat or planar. Additionally, or alternatively, in some examples, one or more of the discrete faces or surfaces (e.g., the surface 620A) can be curved or non-planar. In some examples, one or more of the surfaces 620A, 620B can extend toward one another to define one or more edges 622A, 622B, 622C, 622D and cause the protrusion 618 to have a pyramid shape or other type of polyhedron.

In some examples, the plurality of protrusions 616A can be disposed on the archery bow limb 600 in a repeating or recurring pattern. For example, each protrusion 618 can be displaced equidistantly in one or more directions relative to the other protrusions. In some examples, the plurality of protrusions 616A can be disposed on the archery bow limb 600 at random or otherwise having a non-uniform placement. For example, each protrusion 618 can be displaced varying distances in one or more directions relative to the other protrusions.

Figure 6C:
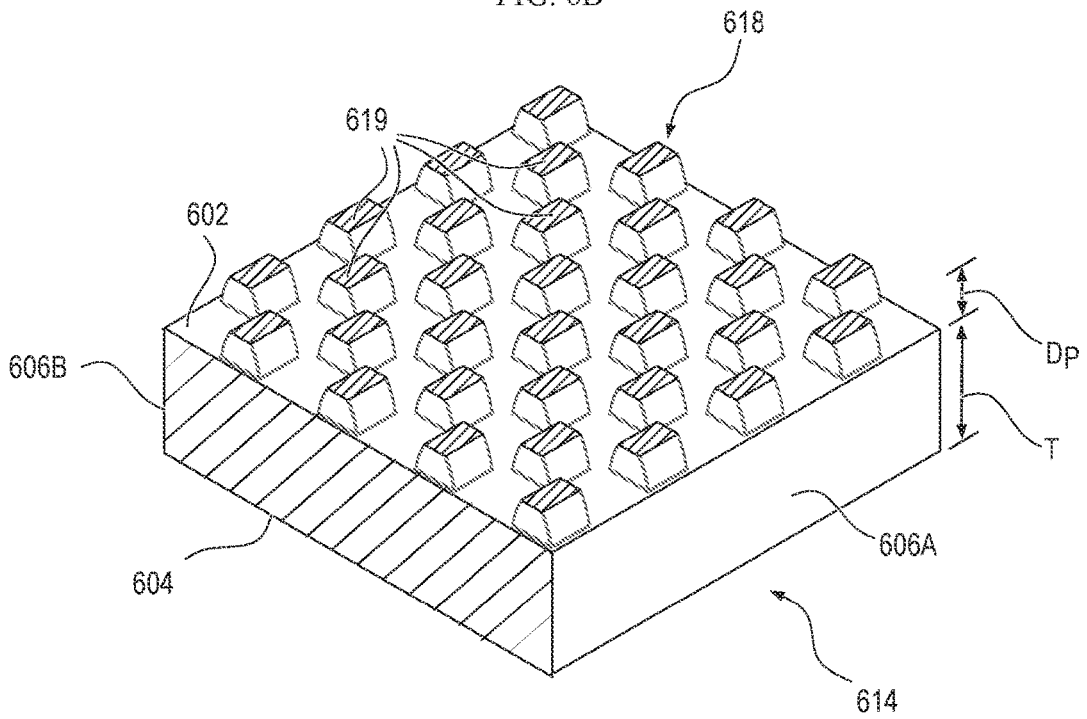
FIG. 6C is a cross-sectional perspective top view of the archery bow limb of FIG. 6B, according to some embodiments.

FIG. 6C shows a view of the pattern including the plurality of protrusions 616A formed on or within the tensile surface 602 wherein each protrusion of the plurality of protrusions 616A is depicted with a projected surface 619. The projected surface 619 is defined by projecting a contact surface (i.e., the surface between each respective protrusion 618 and the tensile surface 602) by a distance $D_P$ from the tensile surface 602. In some examples, the projected surface 619 can be parallel or substantially parallel to the tensile surface 602. The distance $D_P$ can be equal to or less than a minimum thickness T of the limb 600. The minimum thickness T of the limb 600 can be less than about 1 centimeter (cm), between about 1 cm and about 1.5 cm, between about 1.5 cm and about 2 cm, between about 2 cm and about 2.5 cm, between about 2.5 cm and about 3 cm, or greater than 3 cm.

The contact surface (i.e., the surface between each respective protrusion 618 and the tensile surface 602) can define a first surface area that is greater than a second surface area defined by the projected surface 619. In other words, each of the protrusions 618 can taper in one or more directions as the protrusion 618 extends away from the tensile surface 602 and thereby increase a total surface area canceling acoustic waves without a significant mass displaced from the limb 600. In some examples, the first surface area can be five times the second surface area to form a ratio of about 5:1. The ratio defined by the first surface area relative to the second surface area can be about 1.01:1, between about 1.01:1 and about 1.5:1, between about 1.5:1 and about 2:1, between about 2:1 and about 3:1, between about 3:1 and about 4:1, between about 4:1 and about 5:1, equal to or less than 5:1, or greater than 5:1. While a surface area ratio of the projected surface relative to the contact surface was described above referencing FIG. 6C, these aspects of the disclosure are equally applicable to other examples, such as, the plurality of protrusions 616B, 616C illustrated in FIGS. 6D and 6E.

Figure 6D:
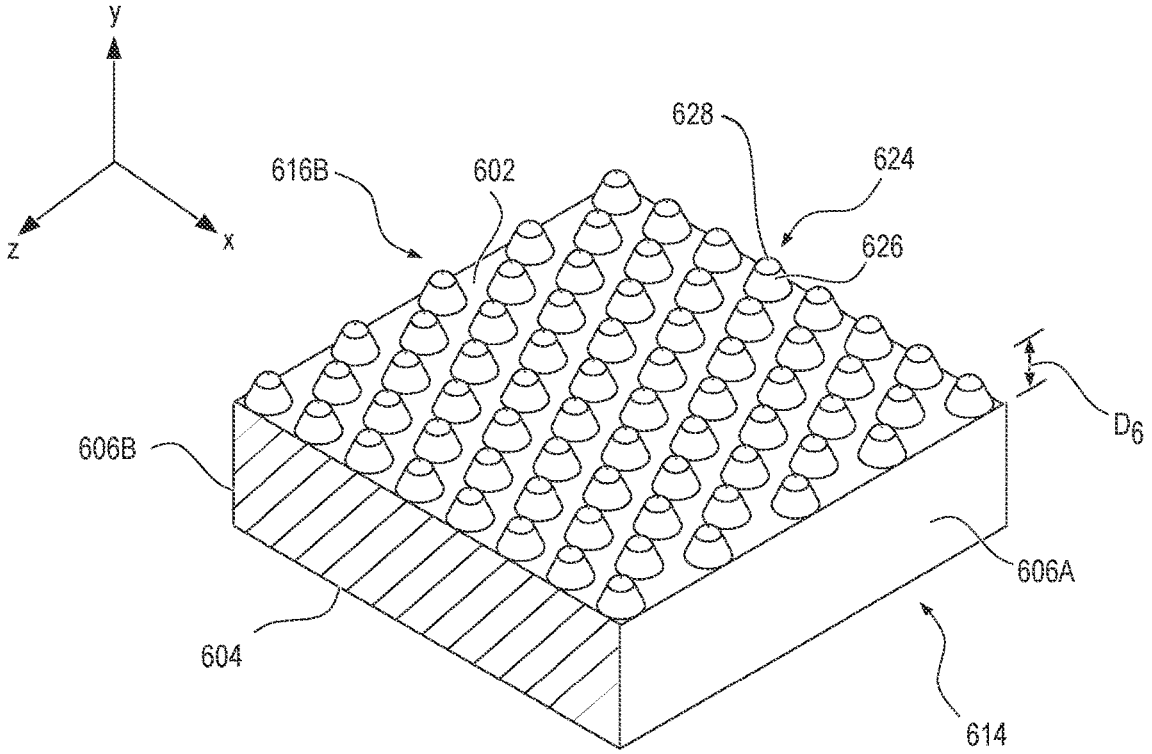
FIG. 6D is a perspective top view of an archery bow limb through section lines 6-6 shown in FIG. 6A, according to some embodiments.

FIG. 6D shows a section view of the archery bow limb 600 through the section lines 6-6 shown in FIG. 6A. More specifically, FIG. 6D shows the portion or region 614 of the tensile surface 602 having a plurality of protrusions 616B. The plurality of protrusions 616B can be adhered, etched, molded, sprayed, deposited, machined, grown, or otherwise disposed on one or more surfaces (e.g., the tensile surface 602, the compression surface 604, the first lateral surface 606A, and/or the second lateral surface 606B) of the archery bow limb 600. Each protrusion 624 of the plurality of protrusions 616B can extend from the respective surface (e.g., the tensile surface 602, the compression surface 604, the first lateral surface 606A, and/or the second lateral surface 606B). For example, the protrusion 624 can extend from the tensile surface 602 in the y-direction by a distance $D_6$. The distance $D_6$ can be less than about 5 millimeters (mm), between about 5 mm and about 10 mm, between about 10 mm and about 15 mm, between about 15 mm and about 20 mm, or greater than about 20 mm. In some examples, one or more protrusions of the plurality of protrusions 616B can extend a particular distance from the archery bow limb 600 and other protrusions of the plurality of protrusions 616B can extend a different distance from the archery bow limb 600. In other words, some of the protrusions of the plurality of protrusions 616B can extend dissimilar or differing distances from the archery bow limb 600 in some examples.

In some examples, each protrusion (e.g., protrusion 624) of the plurality of protrusions 616B can define one or more faces or surfaces 626 extending at angle relative to the one or more surfaces the plurality of protrusions 616B are formed on (e.g., the tensile surface 602, the compression surface 604, the first lateral surface 606A, and/or the second lateral surface 606B). In some examples, the one or more of the faces or surfaces (e.g., the surface 626) can be curved or such that the protrusion 624 has a conical shape that tapers from a relatively wider base to a narrower apex or vertex 628.

In some examples, the plurality of protrusions 616B can be disposed on the archery bow limb 600 in a repeating or recurring pattern. For example, each protrusion 624 can be displaced equidistantly in one or more directions relative to the other protrusions. In some examples, the plurality of protrusions 616B can be disposed on the archery bow limb 600 at random or otherwise having a non-uniform placement. For example, each protrusion 624 can be displaced varying distances in one or more directions relative to the other protrusions.

Figure 6E:
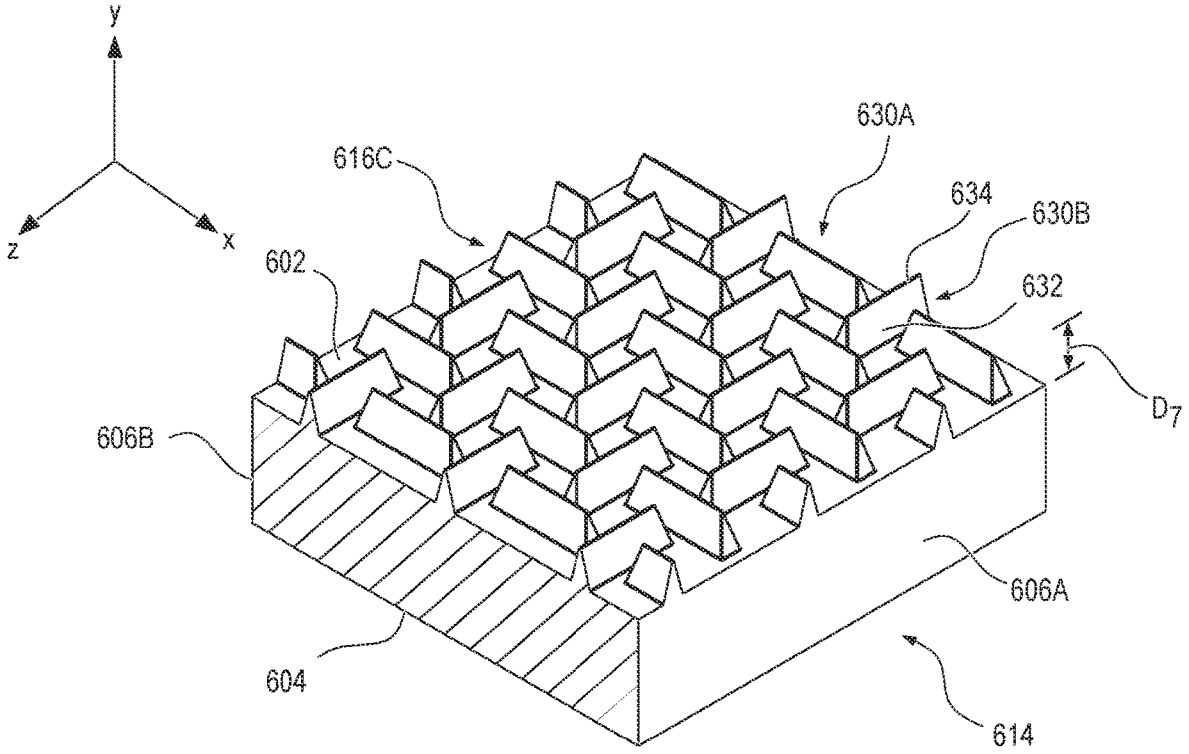
FIG. 6E is a perspective top view of an archery bow limb through section lines 6-6 shown in FIG. 6A, according to some embodiments.

FIG. 6E shows a section view of the archery bow limb 600 through the section lines 6-6 shown in FIG. 6A. More specifically, FIG. 6E shows the portion or region 614 of the tensile surface 602 having a plurality of protrusions 616C. The plurality of protrusions 616C can be adhered, etched, molded, sprayed, deposited, machined, grown, or otherwise disposed on one or more surfaces (e.g., the tensile surface 602, the compression surface 604, the first lateral surface 606A, and/or the second lateral surface 606B) of the archery bow limb 600. Each protrusion of the plurality of protrusions 616C can extend from the respective surface (e.g., the tensile surface 602, the compression surface 604, the first lateral surface 606A, and/or the second lateral surface 606B). For example, a protrusion 630A can extend from the tensile surface 602 in the y-direction by a distance $D_7$. The distance $D_7$ can be less than about 5 millimeters (mm), between about 5 mm and about 10 mm, between about 10 mm and about 15 mm, between about 15 mm and about 20 mm, or greater than about 20 mm. In some examples, one or more protrusions of the plurality of protrusions 616C can extend a particular distance from the archery bow limb 600 and other protrusions of the plurality of protrusions 616C can extend a different distance from the archery bow limb 600. In other words, some of the protrusions of the plurality of protrusions 616C can extend dissimilar or differing distances from the archery bow limb 600 in some examples.

In some examples, the plurality of protrusions 616C can include multiple protrusions disposed in various orientations relative to one another. For example, the plurality of protrusions 616C can include a first protrusion 630A extending along the tensile surface 602 in a first direction (e.g., x-direction) and a second protrusion 630B extending along the tensile surface 602 in a second direction (e.g., z-direction), different from the first direction. One or more of the protrusions 630A, 630B can have an elongated shape or otherwise have a longitudinal axis that extends substantially parallel to the archery bow limb 600.

In some examples, each protrusion (e.g., the second protrusion 630B) of the plurality of protrusions 616C can define multiple discrete faces or surfaces (e.g., surface 632) extending at an angle relative to the one or more surfaces the plurality of protrusions 616C are formed on (e.g., the tensile surface 602, the compression surface 604, the first lateral surface 606A, and/or the second lateral surface 606B). In some examples, one or more of the discrete faces or surfaces (e.g., the surface 632) can be substantially flat or planar. Additionally, or alternatively, in some examples, one or more of the discrete faces or surfaces can be curved or non-planar. In some examples, one or more of the surfaces 632, can extend toward one another to define one or more edges 634.

In some examples, the plurality of protrusions 616C can be disposed on the archery bow limb 600 in a repeating or recurring pattern. In some examples, the plurality of protrusions 616C can be disposed on the archery bow limb 600 at random or otherwise having a non-uniform placement. For example, each protrusion of the plurality of protrusions 616C can be displaced varying distances in one or more directions relative to the other protrusions of the plurality of protrusions 616C. In some examples, varying the respective orientations of respective protrusions can cause the protrusions to flex, bend, or move in particular directions that more efficiently reduces noise and/or dampens vibration when a projectile is launched from the archery bow.

Figure 6F:
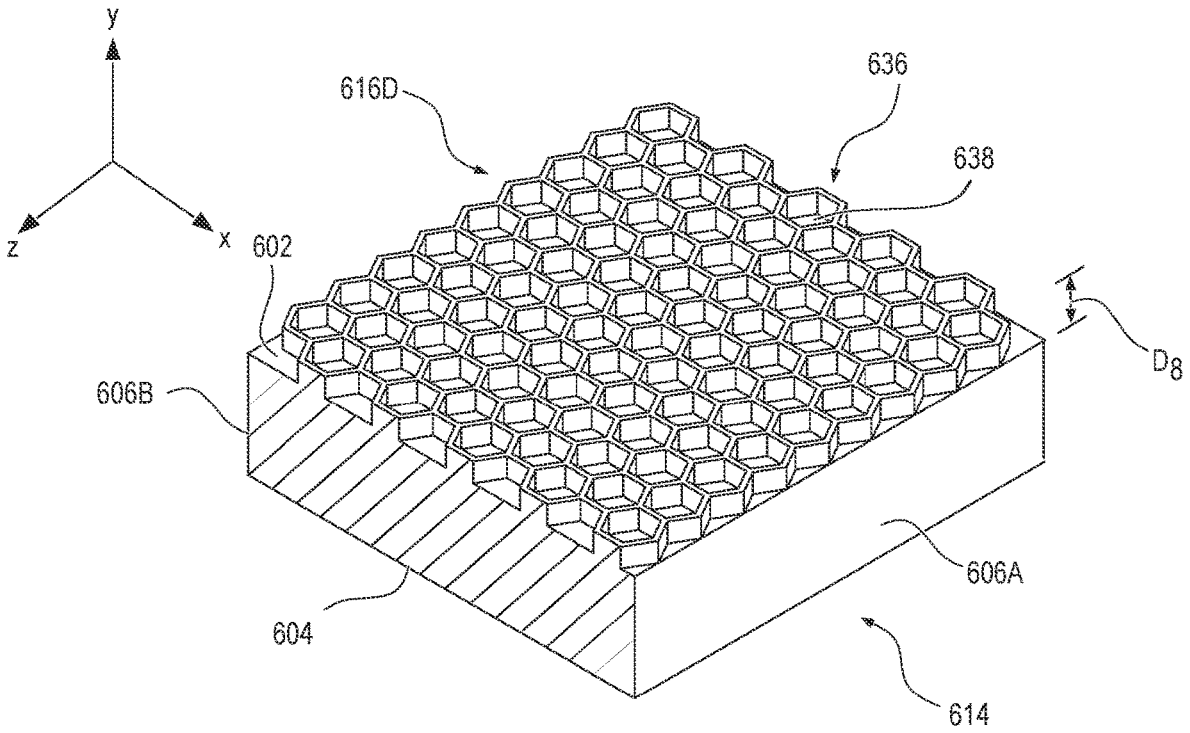
FIG. 6F is a perspective top view of an archery bow limb through section lines 6-6 shown in FIG. 6A, according to some embodiments.

FIG. 6F shows a section view of the archery bow limb 600 through the section lines 6-6 shown in FIG. 6A. More specifically, FIG. 6F shows the portion or region 614 of the tensile surface 602 having a plurality of protrusions 616D. The plurality of protrusions 616D can be adhered, etched, molded, sprayed, deposited, machined, grown, or otherwise disposed on one or more surfaces (e.g., the tensile surface 602, the compression surface 604, the first lateral surface 606A, and/or the second lateral surface 606B) of the archery bow limb 600. Each protrusion (e.g., protrusion 636) of the plurality of protrusions 616D can extend from the respective surface (e.g., the tensile surface 602, the compression surface 604, the first lateral surface 606A, and/or the second lateral surface 606B). For example, a protrusion 636 can extend from the tensile surface 602 in the y-direction by a distance Dg. The distance $D_8$ can be less than about 5 millimeters (mm), between about 5 mm and about 10 mm, between about 10 mm and about 15 mm, between about mm and about 20 mm, or greater than about 20 mm. In some examples, one or more protrusions of the plurality of protrusions 616D can extend a particular distance from the archery bow limb 600 and other protrusions of the plurality of protrusions 616D can extend a different distance from the archery bow limb 600. In other words, some of the protrusions of the plurality of protrusions 616D can extend dissimilar or differing distances from the archery bow limb 600 in some examples.

In some examples, one or more of the protrusions (e.g., a protrusion 636) can be integrally formed with one or more other protrusions of the plurality of protrusions 616D. For example, two or more of the protrusions can be integrally formed to define a structure, such as, the honeycomb structure shown in FIG. 6F. In some examples, one or more protrusions (e.g., protrusion 636) can define a cavity or recess 638. The recess 638 can have a cross-section defining a geometric shape, such as, a hexagon, a circle, an oval, a triangle, a square, a rhombus, a combination thereof, or any other geometric shapes. Additionally, or alternatively, one or more protrusions (e.g., protrusion 636) can define a cavity or recess having a non-geometric shape or an asymmetrical shape. In some examples, at least a portion of the recesses (e.g., recess 638) can be at least partially filled. For example, the plurality of protrusions 616D can be made from a first material and one or more recesses formed by the plurality of protrusions 616D can be at least partially filled with a second material, such as, a thermoplastic elastomer, a Non Newtonian material, metal, a ceramic, a polymer, a combination thereof, or another type of material.

While the plurality of protrusions 616A-D are shown in the region 614 within FIGS. 6B—6F, the plurality of protrusions 616A-D can be disposed anywhere on the tensile surface 602 of the archery bow limb 600 and/or on any other surface or combination of surfaces of the archery bow limb 600 (e.g., the compression surface 604, the first lateral surface 606A, and the second lateral surface 606B). While the region 614 is depicted at a particular location or position on the limb 600, the region 614 can additionally, or alternatively, be disposed or positioned on the limb 600 at a location that is laterally adjacent to a cam coupled to the limb 600 (see region R of FIGS. 1B and 1C).

Figure 7A:
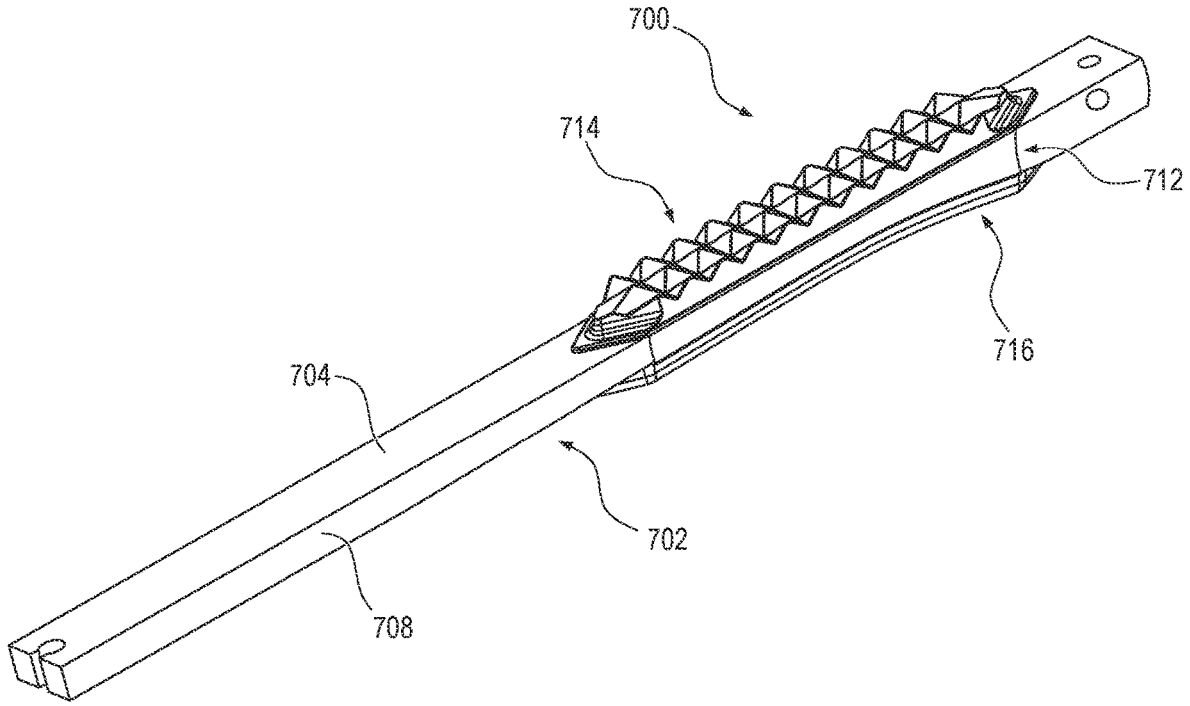
FIG. 7A is a perspective side view of a cover member on an archery bow limb, according to some embodiments.
Figure 7B:
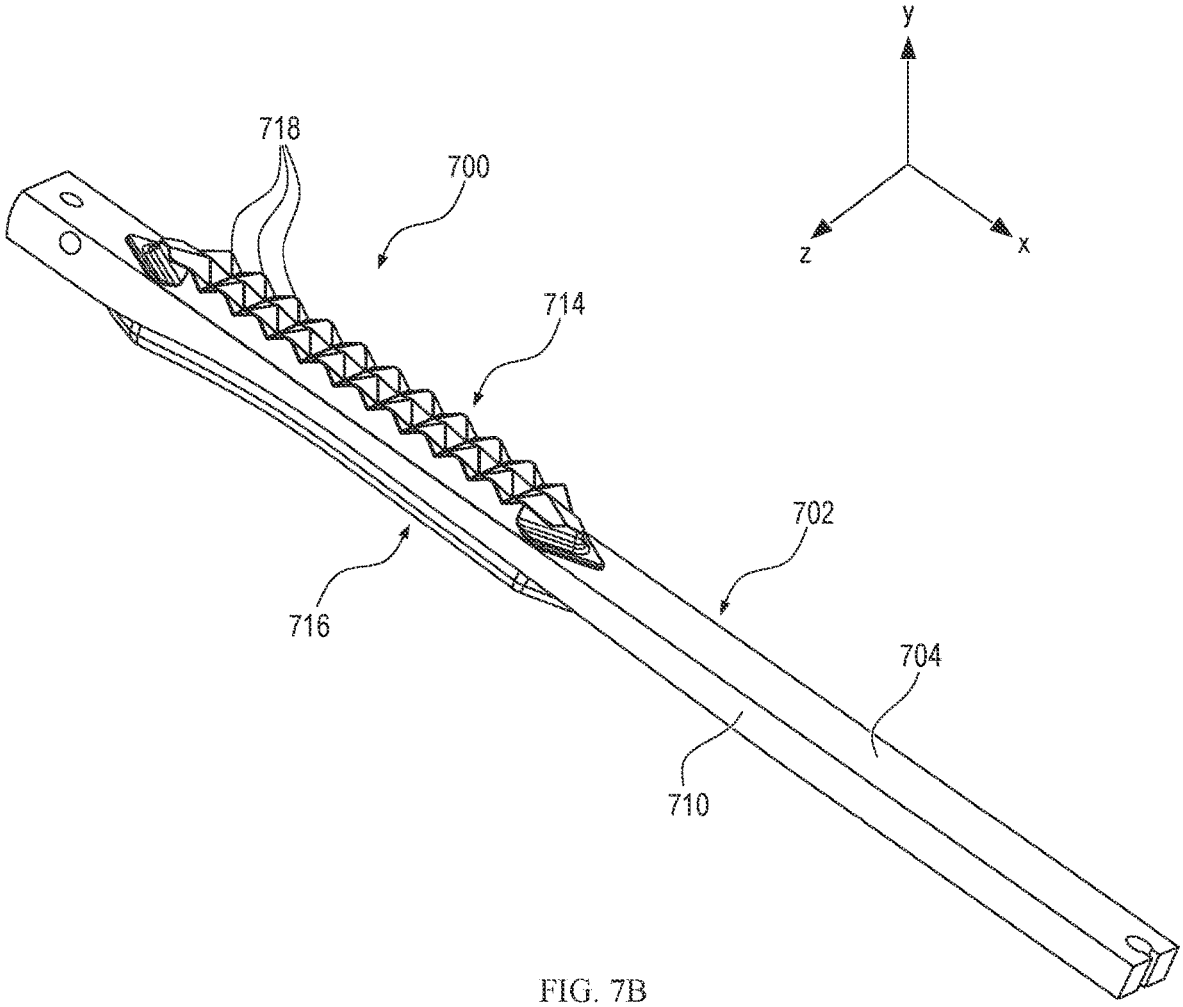
FIG. 7B is a perspective side view of the cover member on an archery bow limb, according to some embodiments.
Figure 7C:
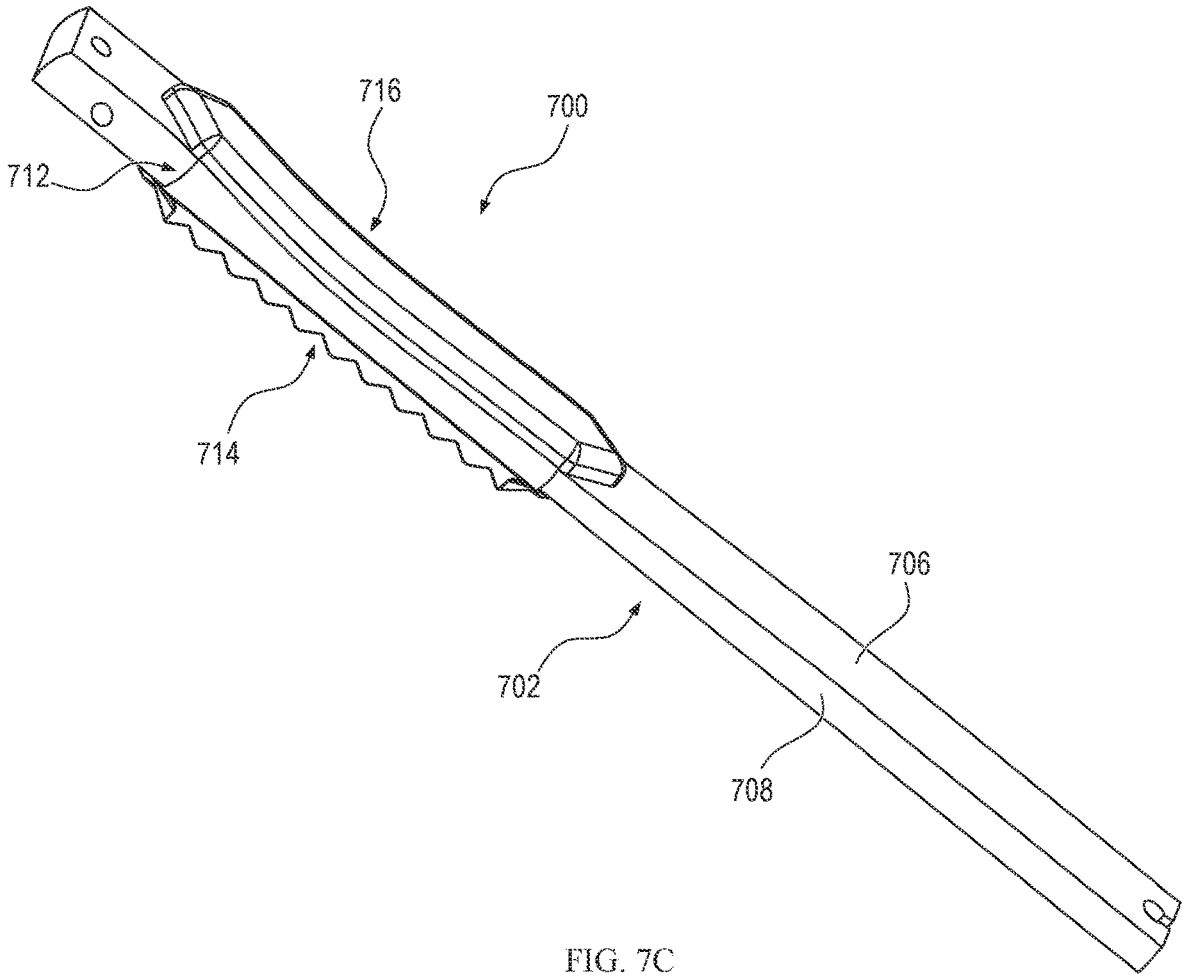
FIG. 7C is a perspective bottom view of the cover member on an archery bow limb, according to some embodiments.

FIGS. 7A-7C show a cover member 700 on an archery bow limb 702. In some examples, the archery bow limb 702 can be substantially similar to, and include some or all of the features of the archery bow limbs 302, 402. For example, the archery bow limb 702 can include a tensile surface 704, a compression surface 706, a first lateral surface 708, and a second lateral surface 710. The cover member 700 can be disposed on one or more of the tensile surface 704, the compression surface 706, the first lateral surface 708, and/or the second lateral surface 710. For example, as shown in FIGS. 7A-7C, the cover member 700 can be disposed on the tensile surface 704, the compression surface 706, and the first lateral surface 708 of the archery bow limb 702 to at least partially envelop a portion of the archery bow limb 702. In some examples, the cover member 700 can be adhered, laminated, molded, fastened, a combination thereof, or otherwise coupled to the archery bow limb 702. While a retaining member (e.g., retaining member 326) is not illustrated in FIGS. 7A-7C, the descriptions of the retaining member 326 herein are equally applicable to the example cover members 700 shown in FIGS. 7A-7E.

The cover member 700 can be substantially similar to, and can include some or all of, the features of the cover members 126A, 126B, 126C, 202, 204, 300, 400, 500. For example, the cover member 700 can include a sidewall 712 extending along the first lateral surface 708 of the archery bow limb 702. In some examples, external-facing surfaces 714, 716 of the cover member 700 and/or the sidewall 712 can have a texture or otherwise include one or more protrusions extending therefrom (see FIGS. 6B-6F). For example, the cover member 700 can include a plurality of protrusions 718 on one or more of the external-facing surfaces 714, 716 of and/or the sidewall 712. The plurality of protrusions 718 can form or define a pattern extending along one or more of the external-facing surfaces 714, 716 in one or more directions (e.g., the x-direction, the y-direction, the z-direction).

Figure 7D:
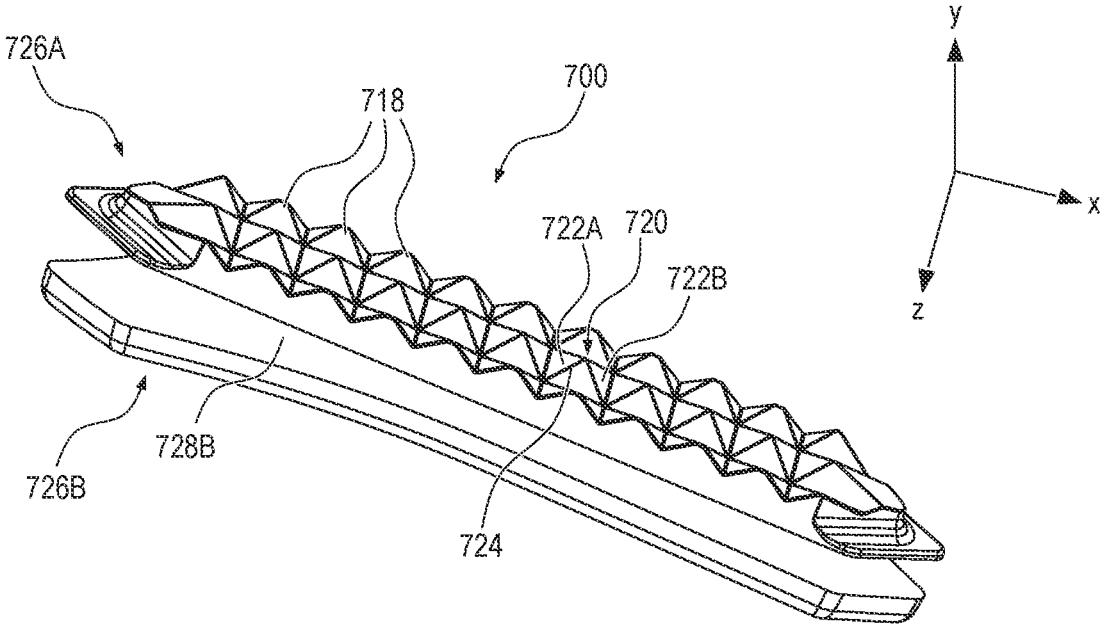
FIG. 7D is a perspective side view of the cover member, according to some embodiments.
Figure 7E:
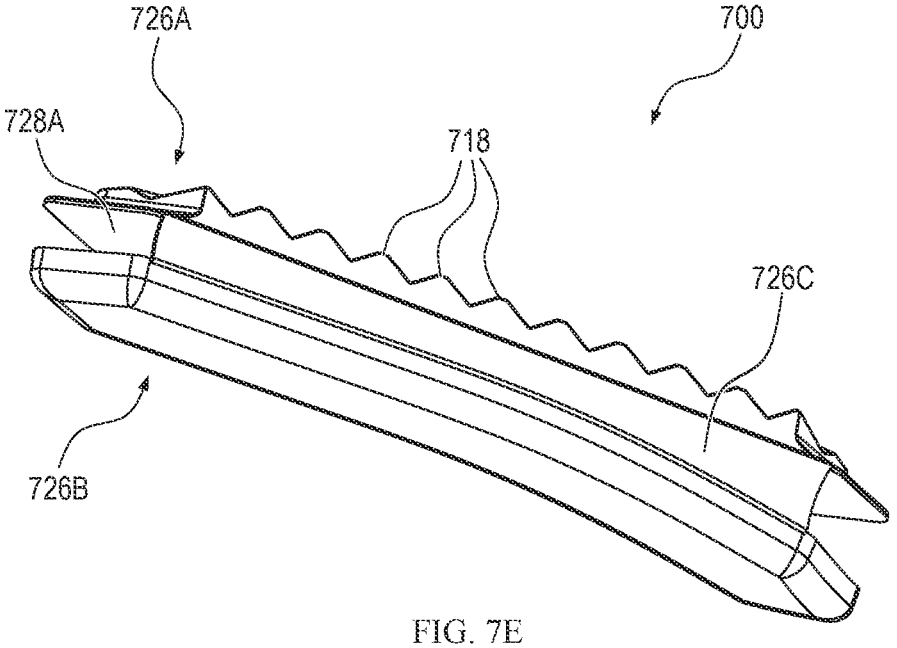
FIG. 7E is a perspective side view of the cover member, according to some embodiments.

FIG. 7D and FIG. 7E show the cover member 700 prior to installation on the limb 702. The plurality of protrusions 718 can be substantially similar to, and can include one or more features of, any singular or combination of the plurality of protrusions 616A-616D described herein with reference to FIGS. 6A-6F. For example, each protrusion (e.g., a protrusion 720) of the plurality of protrusions 718 can define multiple discrete faces or surfaces 722A, 722B extending perpendicular or substantially perpendicular to the one or more surfaces of the cover member 700 the plurality of protrusions 718 are formed on. In some examples, one or more of the discrete faces or surfaces (e.g., the surface 722B) can be substantially flat or planar. Additionally, or alternatively, in some examples, one or more of the discrete faces or surfaces can be curved or non-planar. In some examples, one or more of the surfaces 722A, 722B can extend toward one another to define one or more edges 724 and cause the protrusion 720 to have a pyramid shape or other type of polyhedron.

In some examples, the cover member 700 can include a first section or first portion 726A and a second section or section portion 726B intercoupled or joined by an intermediate section or intermediate portion 726C. For example, the external-facing surface 714 can be at least partially defined by the first portion 726A and the external-facing surface 716 can be at least partially defined by the second portion 726B. Similarly, the sidewall 712 can be at least partially defined by the intermediate portion 726C. The cover member 700 can be printed, molded, machined, stamped, or otherwise formed from polymers, composites, metals, or a combination thereof. For example, the cover member 700 can include a polymer-based foam having a density that is less than a density of the archery bow limb 702. In some examples, the cover member 700 can include a material that provides sound absorption or otherwise reduce or diffuse energy (e.g., acoustic waves) generated when a projectile is launched from the archery bow. In some examples, the cover members 700 can be molded from a semi-deformable rubber, such as, a thermoplastic elastomer. In some examples, the cover member 700 can be at least partially formed from a Non-Newtonian material.

In some examples, the first portion 726A can define a limb-facing surface 728A and the first portion 726A can engage or contact one or more surfaces of the limb 702 (e.g., the tensile surface 704, the compression surface 706, the first lateral surface 708, and/or the second lateral surface 710) at the limb-facing surface 728A. For example, at least a portion of the limb-facing surface 728A can be adhered to the tensile surface 704 of the limb 702. In some examples, the second portion 726B can define a limb-facing surface 728B and the second portion 726B can engage or contact one or more surfaces of the limb 702 (e.g., the tensile surface 704, the compression surface 706, the first lateral surface 708, and/or the second lateral surface 710) at the limb-facing surface 728B. For example, at least a portion of the limb-facing surface 728B can be adhered to the compression surface 706 of the limb 702. In some examples, the intermediate portion 726C can define a limb-facing surface (not shown) and the intermediate portion 726C can engage or contact one or more surfaces of the limb 702 (e.g., the tensile surface 704, the compression surface 706, the first lateral surface 708, and/or the second lateral surface 710) at the limb-facing surface. For example, at least a portion of the limb-facing surface can be adhered to one of the first or second lateral surfaces 708, 710 of the limb 702.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow, comprising:

a riser;

a limb coupled to the riser;

a cam rotatably coupled to the limb, the limb having a region disposed laterally adjacent to the cam; and a cover member coupled to the limb, a majority of the cover member being disposed on the region.

2. The archery bow of claim 1, wherein:

the limb defines a tensile surface and a compression surface disposed opposite the tensile surface; and at least a portion of the tensile surface or the compression surface forms the region.

3. The archery bow of claim 1, wherein:

the limb defines a first lateral surface and a second lateral surface; and the cover member is at least partially disposed on at least one of the first lateral surface or the second lateral surface.

4. The archery bow of claim 1, wherein:

the limb comprises a distal end and a proximal end; and a first distance between the distal end of the limb and the cover member is less than a second distance between the proximal end of the limb and the cover member.

5. The archery bow of claim 1, further comprising an axle rotatably coupling the cam to the limb, wherein the region is defined between the axle and a periphery of the cam.

6. The archery bow of claim 1, wherein the cover member has a first density and the limb has a second density greater than the first density.

7. The archery bow of claim 1, wherein the limb is a first limb and the cover member is a first cover member, the archery bow further comprising:

a second limb; and a second cover member disposed on the second limb.

8. The archery bow of claim 1, wherein the limb defines a first length and the cover member defines a second length, a ratio of the first length to the second length being equal to or between 5:1 and 1.5:1.

9. A cover member for an archery bow limb, comprising:

a body defining a limb-facing surface and an external-facing surface, the limb facing-surface is configured to affix to at least one of a tensile surface of the archery bow limb or a compression surface of the archery bow limb;

a sidewall coupled to the body and extending substantially perpendicular to the limb-facing surface of the body; and a pattern formed within the external-facing surface, the pattern extending along the external-facing surface in a first direction and a second direction.

10. The cover member of claim 9, wherein:

the first direction is transverse to a longitudinal axis of the body; and the second direction is parallel to the longitudinal axis of the body.

11. The cover member of claim 9, wherein the sidewall defines a limb-facing surface configured to be coupled to a lateral surface of the archery bow limb.

12. The cover member of claim 9, wherein the pattern comprises a plurality of protrusions disposed on the external-facing surface.

13. The cover member of claim 12, wherein the plurality of protrusions are arranged in a repeating pattern.

14. The cover member of claim 12, wherein the plurality of protrusions are arranged in a random pattern.

15. The cover member of claim 9, wherein a width of the body varies over a length of the body.

16. The cover member of claim 9, wherein the cover member is configured to be affixed further from a proximal end of the archery bow limb than a distal end of the archery bow limb.

17. A limb assembly for an archery bow, comprising:

a limb including a first surface defining a plurality of protrusions forming projected surfaces offset a distance from the first surface, the distance being less than or equal to a minimum thickness of the limb;

wherein the plurality of protrusions and the limb are formed of a same material, the plurality of protrusions being integral to the first surface.

18. The limb assembly of claim 17, wherein the first surface is parallel to the projected surfaces.

19. The limb assembly of claim 17, wherein the first surface is disposed nearer a distal end of the limb than a proximal end of the limb.

20. The limb assembly of claim 17, wherein the plurality of protrusions comprise machined protrusions or etched protrusions formed from the first surface.

* * * * *